US011486557B2

(12) United States Patent
Nakanishi et al.

(10) Patent No.: US 11,486,557 B2
(45) Date of Patent: Nov. 1, 2022

(54) VEHICLE LAMP, LAMP UNIT, AND REFLECTOR MODULE

(71) Applicant: Koito Manufaturing Co., LTD., Tokyo (JP)

(72) Inventors: Yoshiyuki Nakanishi, Shizuoka (JP); Teppei Muramatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 17/286,312

(22) PCT Filed: Oct. 18, 2019

(86) PCT No.: PCT/JP2019/041062
§ 371 (c)(1),
(2) Date: Apr. 16, 2021

(87) PCT Pub. No.: WO2020/080512
PCT Pub. Date: Apr. 23, 2020

(65) Prior Publication Data

US 2021/0341127 A1 Nov. 4, 2021

(30) Foreign Application Priority Data

Oct. 19, 2018 (JP) ..... JP2018-197477
Oct. 19, 2018 (JP) ..... JP2018-197513
(Continued)

(51) Int. Cl.
*F21S 41/25* (2018.01)
*F21S 41/675* (2018.01)
(Continued)

(52) U.S. Cl.
CPC ..... *F21S 41/675* (2018.01); *F21S 41/148* (2018.01); *F21S 41/25* (2018.01); *F21S 41/28* (2018.01);
(Continued)

(58) Field of Classification Search
None
See application file for complete search history.

(56) References Cited

U.S. PATENT DOCUMENTS

2011/0080751 A1* 4/2011 Mochizuki ..... G01M 11/068 362/530
2013/0038736 A1* 2/2013 Yamamura ..... F21S 41/155 348/148
(Continued)

FOREIGN PATENT DOCUMENTS

JP 2018-67523 A 4/2018
WO 2009/147799 A1 12/2009
WO 2018/235691 A1 12/2018

OTHER PUBLICATIONS

Extended European Search Report issued for EP19873574.8, dated Nov. 5, 2021, 9 pages.

*Primary Examiner* — Elmito Breval
(74) *Attorney, Agent, or Firm* — Lewis Rice LLC

(57) ABSTRACT

To provide a vehicle lamp that, without providing an additional light blocking member, is capable of blocking light emission that is not routed via a lens or reflector for light distribution control, with a simple and compact configuration. It is provided with a first substrate 61b on which a first light source 61a is mounted that emits first light L1 towards the front of the lamp, a second substrate 62b provided in non-parallel to the first substrate 61b, wherein a second light source 62a for emitting second light L2 in a direction different from the direction of the first light L1 is mounted on the second substrate, and a rotating reflector 8 that rotates
(Continued)

a reflective surface about a rotating shaft, the reflective surface reflecting the second light L2, wherein part of the first light L1 is blocked by a protruding portion 62c provided where one end of the second substrate 62b protrudes in the direction of emission of the first light L1 beyond the point of intersection where the extension of the first substrate 61b intersects the second substrate 62b.

15 Claims, 30 Drawing Sheets

(30) Foreign Application Priority Data

Oct. 30, 2018 (JP) ..... JP2018-203664
Nov. 26, 2018 (JP) ..... JP2018-220423

(51) Int. Cl.
*F21S 41/20* (2018.01)
*F21S 41/148* (2018.01)
*F21S 41/43* (2018.01)
*F21S 45/47* (2018.01)
*F21S 41/39* (2018.01)

(52) U.S. Cl.
CPC ..... *F21S 41/39* (2018.01); *F21S 41/43* (2018.01); *F21S 45/47* (2018.01)

(56) References Cited

U.S. PATENT DOCUMENTS

2014/0313755 A1* 10/2014 Tanaka ..... F21S 41/16 362/514
2016/0341388 A1 11/2016 Tanaka et al.

* cited by examiner

FIG. 5(a)
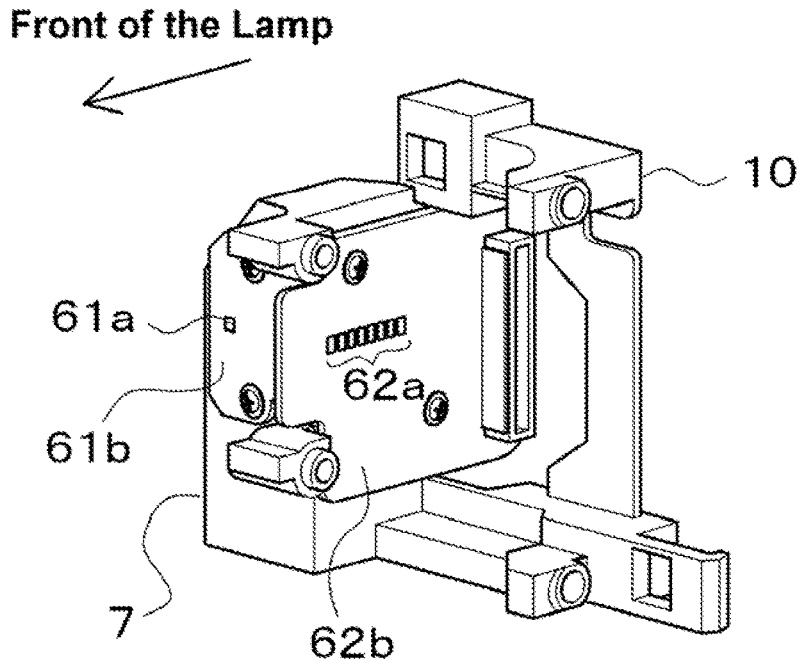
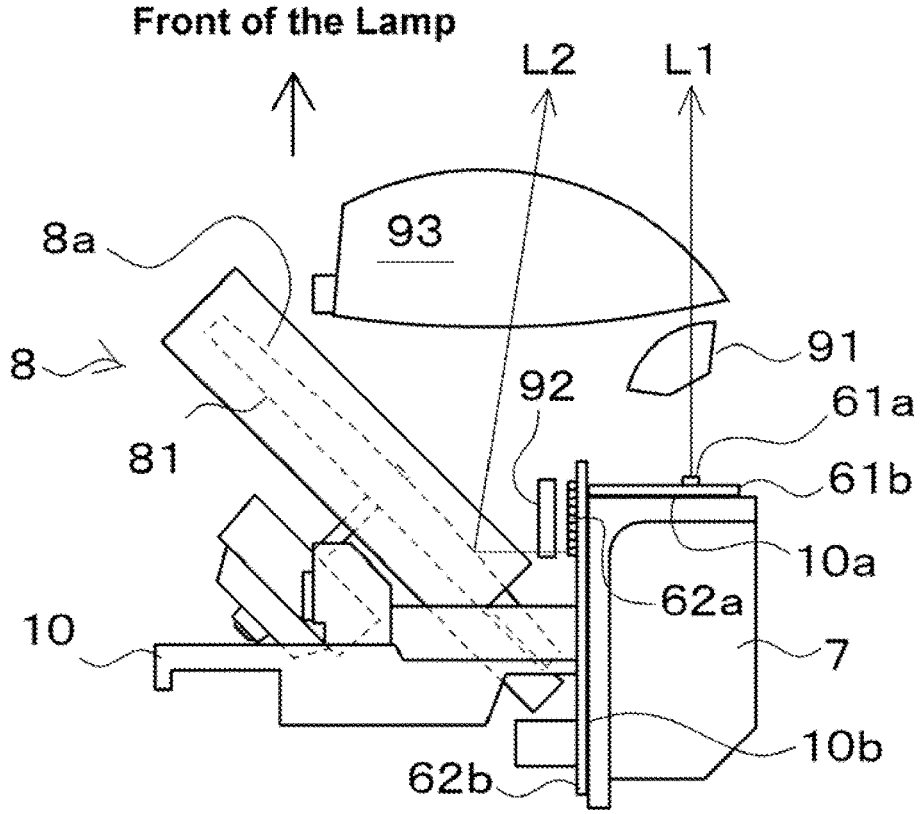
FIG.5(b)

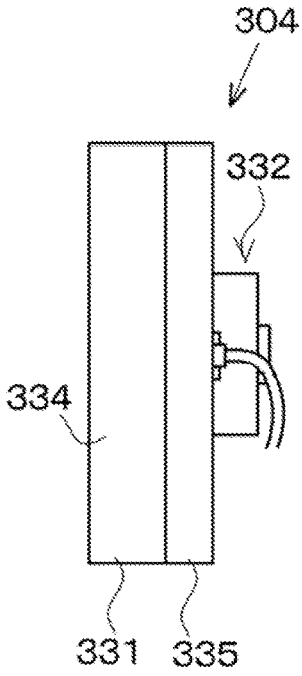
FIG. 18(a)
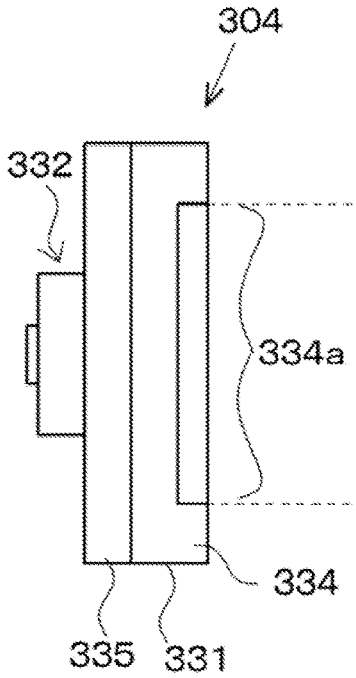
FIG. 18(b)
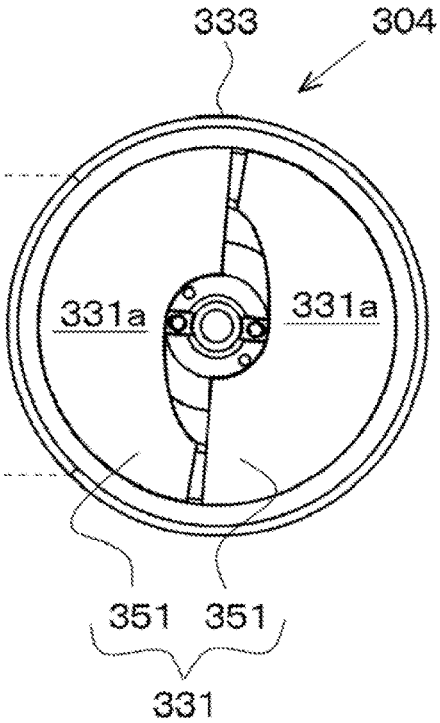
FIG. 18(c)
FIG. 18(d)
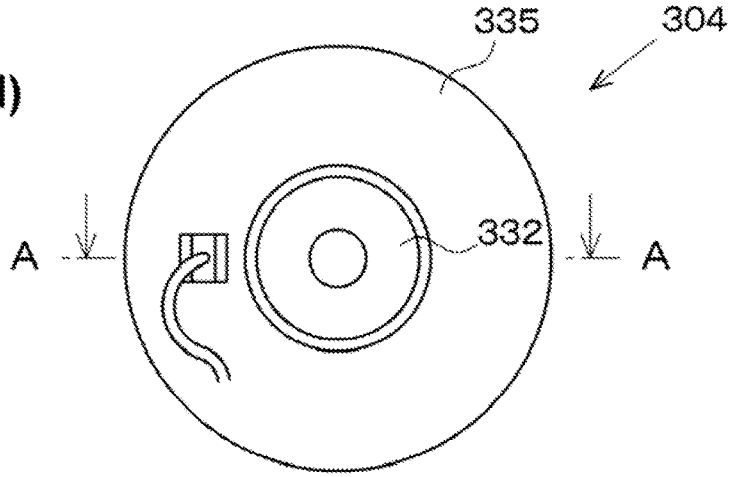

(a)

VEHICLE LAMP, LAMP UNIT, AND REFLECTOR MODULE

CROSS REFERENCE TO RELATED APPLICATION(S)

This application is a § 371 U.S. National Phase of International Application Serial No.: PCT Application No.: PCT/JP2019/041062 filed Oct. 18, 2019 which in turn claims priority to Japanese Patent Application Serial No.: 2018-197477, filed Oct. 19,2018: Japanese Patent Application Serial No.: 2018-197513, filed Oct. 19, 2018: Japanese Patent Application Serial No.: 2018-201664, filed Oct. 30, 2018: and Japanese Patent Application Serial No. 2018-220423, filed Nov. 26, 2018. The entire disclosure of all the above documents is herein incorporated by reference.

TECHNICAL FIELD

The present invention relates to a vehicle lamp that uses a rotating reflector to control light emitted from a plurality of light sources so as to form a desired distribution of light, a lamp unit, and a reflector module.

BACKGROUND ART

Conventionally, vehicle lamps have been known that are provided with a rotating reflector that rotates the reflective surfaces of the reflector about the rotating shaft, wherein the light reflected from the rotating reflector is adjusted by a lens to perform light distribution control. For example, Patent Document 1 discloses a technology that provides a plurality of light sources and performing control to form a desired distribution of light by reflecting the light from each light source in a different location on the rotational reflective surfaces. Also known is a technology related to a blade scan method in which rectilinear light emitted from a light source unit is reflected from a rotating reflector with reflective surfaces that rotate about a rotating shaft to project a complicated light distribution pattern in front of the lamp. Patent Document 3 describes a technology in which a rotating reflector is used to illuminate a wide range of area in front of the vehicle. Patent Document 4 describes a technology to mitigate the brightness changes near light/dark boundaries by shifting and superimposing the light distribution patterns formed by a rotating reflector.

CITATION LIST

Patent Literature

Patent Document 1: Japanese Published Unexamined Patent Application No. 2015-026628

Patent Document 2: Japanese Published Unexamined Patent Application No. 2018-085217

Patent Document 3: Japanese Published Unexamined Patent Application No. 2018-067523

Patent Document 4: Japanese Published Unexamined Patent Application No. 2018-073485

SUMMARY OF INVENTION

Problems to be Solved by the Invention

In light distribution control using a rotating reflector, there is a possibility of producing glare in front of the vehicle because part of the light emitted from the light source may be projected to the front of the lamp without being routed via the rotating reflector and lens and without undergoing light distribution control. In this regard, it has been known for some time that a light blocking member is placed inside the lamp to block light that is unnecessary for light distribution control. For example, Patent Document 2 discloses a vehicle lamp with first and second light emitting elements and first and second reflective surfaces, and a light blocking member that blocks the light emitted by the first light emitting elements from entering the second reflective surface.

According to the vehicle lamp of Patent Document 2, however, the number of parts increases as the light blocking member is provided as a separate part, which results in an increased complexity of the lamp and an increased size of the lamp.

In the lamp unit that uses a blade scan method, a cover lens is provided to distribute the light emitted from the light emitting elements towards the reflective surfaces of the rotating reflector. The cover lens comprises an integrally molded transparent member, has a light distribution control portion that controls the direction of the light, and a leg portion that support the light distribution control portion, and is arranged to cover the light emitting elements.

According to the conventional configuration, however, a part of the incident light from the light emitting elements leaks through the leg portion of the cover lens and is projected to the front of the lamp without undergoing light distribution control, which may hinder the formation of a desired light distribution pattern. In addition, a part of the light incident from the light emitting elements bypasses the reflective surfaces of the rotating reflector and is projected to the front of the lamp, hindering the formation of the intended light distribution pattern in this case as well.

Furthermore, FIG. 21(*a*) shows a rotating reflector provided with a motor 332 that rotates the reflector blades and a harness 358 for supplying power to the motor on the back side of the reflector. As the harness 358 needs to be installed near the motor 332, should the harness 358 move due to the vibration of the vehicle or the rotational vibration of the motor 332 to come into contact with the motor 332 during high speed rotation, the harness 358 may be damaged, which leaves room for improvement.

In a lamp unit that uses the blade scan method, a lens is placed at the front of the lamp unit to superimpose the direct light from a light source and the light routed via the rotating reflector. For this reason, the lens portion is a particularly eye-catching part of the lamp unit design and has a large impact on the design of the lamp unit.

However, as shown in FIG. 30(*a*), when using a conventional lens holder 468, the fastening portions 434 for fastening screws to a support member 7 protrude considerably and laterally from the lens holder 433, which makes the outer shape of the lens portion appear larger in the front view of the lamp unit 362, as shown in FIG. 30(*b*), impairing the appearance of the lamp unit.

Therefore, objects of the present invention is to provide a vehicle lamp capable of blocking light unwanted for light distribution control without installing an additional part and by means of a simple and compact configuration, a lamp unit capable of blocking the part of the light emitted from the cover lens that is not controlled for light distribution, a reflector module and a lamp unit capable of preventing contact between the motor and the power feed harness, and an lamp unit with a good appearance having a lens holder configured to make the fastening portions inconspicuous.

Means to Solve the Problems (1) In order to solve the problem described above, a vehicle lamp of the present invention comprises a first substrate on which a first light source for emitting first light to a front of the lamp is mounted, a second substrate provided in non-parallel to the first substrate, the second substrate having a second light source mounted thereon for emitting second light in a direction different from the direction of the first light; and a reflector for reflecting the second light to the front of the lamp, the vehicle lamp being characterized in that the second substrate blocks part of the first light.

Herein, one end of the second substrate protrudes in the direction of emission of the first light beyond the point of intersection where an extension of the first substrate intersects the second substrate, and the protruding portion blocks the unwanted light.

Moreover, the vehicle lamp of the present invention is further configured to comprise an inner lens for projecting the first light to the front of the lamp, and wherein the protruding portion is configured to block part or all of the first light not entering the inner lens as unwanted light.

Furthermore, the vehicle lamp of the present invention is further configured to comprise a projection lens allowing the first light projected by the inner lens and the second light reflected by the reflector to enter the projection lens and projecting the first and second light to the front of the lamp, and wherein the protruding portion is configured to block the part of the first light that does not enter the inner lens from entering the projection lens as unwanted light.

Additionally, the first substrate and the second substrate are mounted via heat-dissipating grease on a heat sink for dissipating heat generated by light emitting elements serving as the first light source and the second light source. Moreover, an accommodation portion capable of accommodating an excess amount of the heat-dissipating grease is provided between an end of the first substrate and a rear face of the second substrate.

(2) In order to solve the problem described above, a lamp unit of the present invention comprises a light emitting element, a substrate on which the light emitting element is mounted, a rotating reflector for rotating a reflective surface about a rotating shaft, the reflective surface reflecting light of the light emitting element, a rotating reflector case that holds the rotating reflector, a projection lens for projecting the light traveling via the reflective surface to a lamp front, a lens holder that holds the projection lens, and a support member that supports the substrate, the rotating reflector, and the lens holder, the lamp unit including a cover lens that is disposed between the light emitting element and the reflective surface and made of a transparent member that transmits the light emitted by the light emitting element, and a fixing member that secures the cover lens to the substrate, the lamp unit being characterized in that the fixing member blocks part of the light emitted from the cover lens.

The cover lens includes a light distribution control portion for projecting the light emitted from the light emitting element to the reflective surface of the rotating reflector, the cover lens further including a leg portion integrally molded with the light distribution control portion, and in the case where the fixing member includes an opening that exposes the light distribution control portion, the fixing member blocks the part of the light emitted from the cover lens that does not enter the light distribution control portion.

The fixing member may be configured to include a vertical wall on at least part of a peripheral edge of the opening, the vertical wall blocking part of the light emitted by the light emitting element. The vertical wall is interposed between the projection lens and the cover lens and blocks part of the light emitted by the light emitting element that is not projected to the rotating reflector.

(3) In order to solve the problem described above, a reflector module of the present invention comprises a reflector with a reflective surface on a front side and a case that contains the reflector, the reflector module characterized in that a vertical wall is provided on a periphery of an inner bottom surface of the case, the vertical wall enclosing an outer peripheral surface of the reflector, and that a motor is disposed on a back side of the reflector for rotating the reflector about a rotating shaft via a bottom of the case. In this case, it is preferred that the front side of the reflector be contained further inward than a plane defined by a top end of the vertical wall.

Further, the motor may include a motor drive unit for driving the motor, and a cover may be provided on an outer bottom surface of the case to cover at least part of the motor drive unit. Preferably, the motor drive unit includes a yoke portion and a control circuit board on which a control circuit for controlling the yoke portion is mounted, the cover includes an opening that exposes part of the yoke portion, and a gap formed between the yoke and the control circuit board is provided where the gap is not exposed via the opening.

It is preferred that a retainer member be provided on an outer bottom surface of the cover to retain, in a predetermined position, a wiring member used to supply power to the motor. Optionally, the retainer member may include a shielding wall that shields the wiring member and the yoke portion from coming into contact with each other, and an engaging portion that supports the wiring member from both sides thereof may be provided in a portion of the shielding wall.

Moreover, a lamp unit of the present invention comprises a reflector module a light emitting element substrate on which a light emitting element for emitting light to the reflective surface of the reflector is mounted, a support member including a mounting surface on which the light emitting element substrate is mounted, and a projection lens for projecting the light reflected by the reflective surface to a lamp front, wherein the support member supports the light emitting element substrate so that the light from the light emitting element is directed to the reflector, and supports the reflector module in a position where the rotating shaft of the reflector is inclined with respect to the mounting surface, the lamp unit being characterized in that the vertical wall includes a recess or cutout in the portion thereof located rear of the light emitting element in the lamp, the recess preventing interference with the support member.

(4) In order to solve the problem described above, a lamp unit of the present invention comprises a light emitting element, a substrate on which the light emitting element is mounted, a rotating reflector for rotating a reflective surface about a rotating shaft, the reflective surface reflecting light of the light emitting element, a rotating reflector case that holds the rotating reflector, a lens for projecting the light traveling via the reflective surface to a lamp front, a lens holder that holds the lens, and a support member that supports the substrate, the rotating reflector, and the lens holder, wherein the lens holder includes a main body that holds the lens and fastening portions that fasten the main body to the support member, and the lamp unit characterized in that the fastening portions have base ends thereof on the main body, and are erected towards a lamp rear, the fastening portions being disposed where the fastening portions are shielded by the lens and the main body as seen from a front of the lamp unit.

The lens holder may be configured to include two or more of the fastening portions and an approximately U-shaped reinforcing member that has base ends thereof on one fastening portion and another fastening portion and extends towards the lamp rear. It is preferred that the main body be formed in a shape of an approximate rectangular frame, and that the fastening portions be provided in approximate centers of a pair of long sides of the main body. In addition, preferably, the fastening portions are provided with a hole into which a bar-shaped fastening member is inserted, and the holes are open in a direction parallel to a lens surface of the lens.

Furthermore, the substrate and the rotating reflector case have holes into which a bar-shaped fastening member can be inserted, and it is preferred that the holes in the substrate and the rotating reflector case be open in the same direction as the holes in the lens holder.

In addition to the above, the rotating reflector case may be mounted to the support member, which supports the lens holder, so that the rotating shaft of the rotating reflector is not parallel to an optical axis of the lens, and ribs oriented towards the rotating reflector case may be erected on the fastening portions and the reinforcing member of the lens holder. In this case, it is preferred that the ribs of the reinforcing member be configured to be lower than the ribs of the connecting portions.

Effects of the Invention

The present invention provides effects (1)-(4) as set forth below:

(1) As part of the second substrate is extended to a position where it blocks unwanted light emitted from the first light source, the present invention provides the effect of easily and effectively blocking unwanted light.

(2) As the fixing member of the cover lens is modified to block uncontrolled light, the present invention provides the effect of forming a desired light distribution pattern while reducing the number of parts of the lamp unit and keeping the size of the lamp unit small.

(3) As the reflector is provided with a case, and the vertical wall is provided on the case to surround the outer peripheral surface of the reflector, the present invention provides the effect of isolating the rotating reflector from other members located in proximity to prevent the reflector from coming into contact with other members. Moreover, as a cover is provided on the back side of the reflector and a retainer member for retaining wiring for supplying power to the motor is provided on the outer bottom surface of the cover, the present invention provides the effect of preventing contact between the yoke and the wiring member.

(4) As the fastening portions of the lens holder have their base ends on the main body and are erected towards the lamp rear, and the fastening portions of the lens holder are disposed where the fastening portions are shielded by the lens and the main body as seen from the front of the lamp unit, the present invention provides a remarkable effect of making the fastening portions are inconspicuous and improving the appearance of the lamp unit.

BRIEF DESCRIPTION OF THE DRAWINGS

FIG. 5(*a*) shows a perspective view of a support member on which first and second substrates are mounted, as seen from the front of the lamp, and FIG. 5(*b*) shows a plan view of the support member.

FIG. 18(*a*) is a right side view of the reflector module of FIG. 16, FIG. 18(*b*) is a left side view thereof, FIG. 18(*c*) is a front view thereof, and FIG. 18(*d*) is a rear view thereof.

DETAILED DESCRIPTION OF EMBODIMENTS

The following describes the present invention embodied as a vehicle lamp, a lamp unit, and a reflector module with reference to the drawings. In each of the drawings, identical symbols designate identical or similar components.

Embodiment 1

Figure 1:
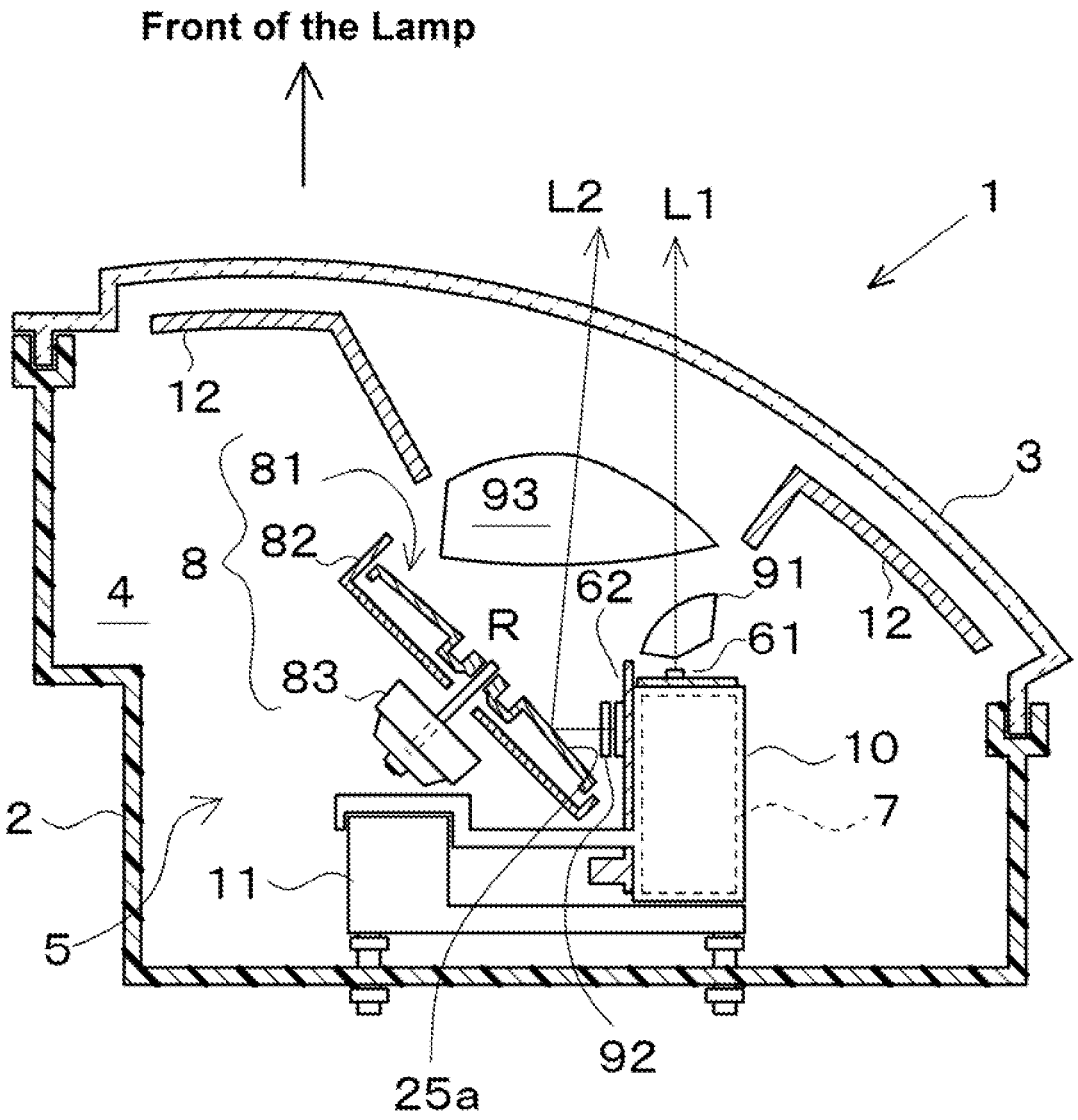
FIG. 1 is a cross-sectional view of a vehicle lamp as seen from above the vehicle, representing Embodiment 1 of the present invention.
Figure 2:
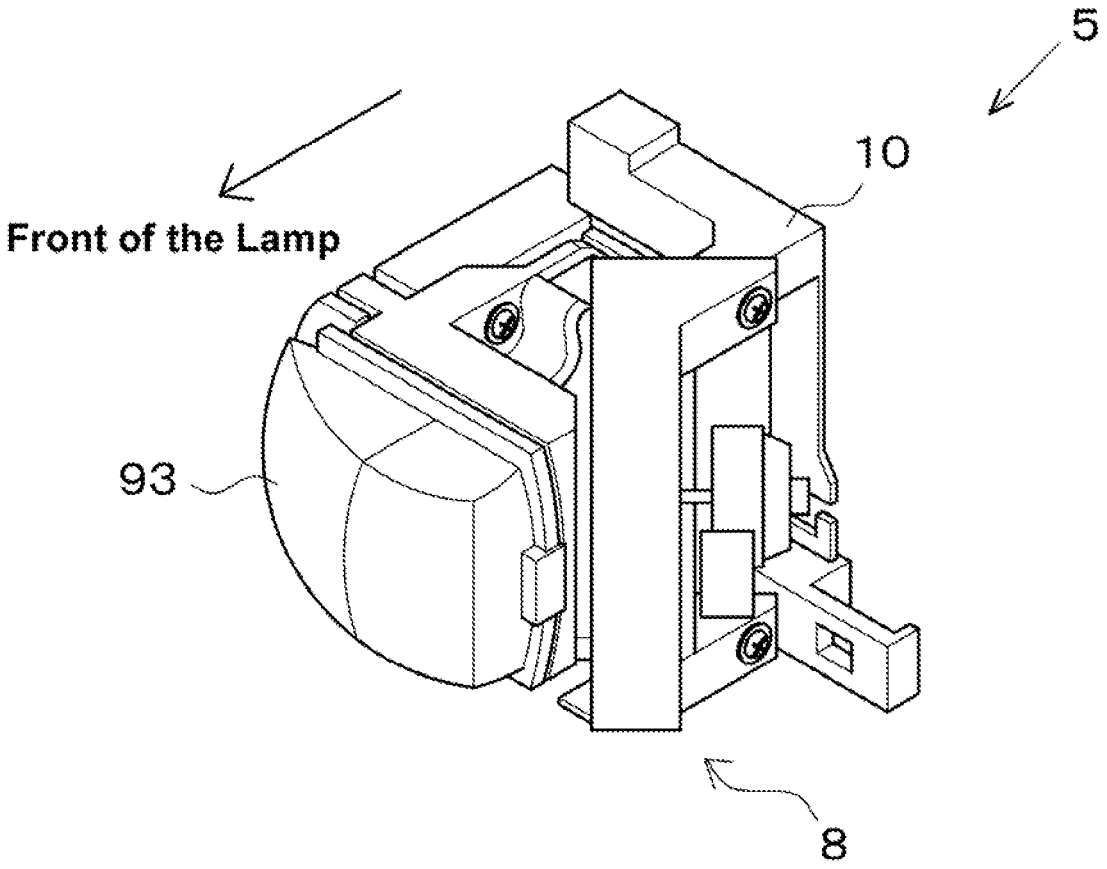
FIG. 2 is a perspective view of a lamp unit seen from the front of the lamp.

As shown in FIGS. 1 and 2, a vehicle lamp 1 of Embodiment 1 according to the present invention is a vehicle headlamp that comprises a lamp body 2 to be mounted on a vehicle body, a translucent cover 3 covering the front of the lamp body 2, and a lamp chamber 4 formed between these two members, and a lamp unit 5 disposed in the center of the lamp chamber 4. It should be noted that the lamp unit 5 of this embodiment is an optical unit that controls distribution of light by a blade scan method. The blade scan method is one of the ADB (Adaptive Driving Beam) technologies that detect the conditions surrounding the vehicle, for example, whether there is a vehicle ahead, an oncoming vehicle, or a pedestrian in front of the vehicle, and control the area corresponding to the vehicle or pedestrian to have a desired light distribution pattern. In the blade-scanning method, a reflector (blades) with predetermined curved reflective surfaces is rotated about a rotating shaft to reflect incident light at an angle corresponding to the rotational position of the blades, and the reflected light is repeatedly scanned at high speed in front of the vehicle. Then, based on the results of the scanning, the on/off and the light intensity of the light source is changed according to the rotational position of the reflector to form a desired light distribution pattern in front of the vehicle according to the traffic conditions.

The lamp unit 5 is provided with first and second light source units 61 and 62, a reflector module 8, inner lenses 91 and 92, a projection lens 93, and a support member 10. The light source units 61 and 62, the reflector module 8, the inner lenses 91 and 92, and the projection lens 93 are supported by the support member 10. The support member 10 is integrally molded with heat radiation fins 7 and held to the lamp body 2 by an aiming adjustment member 11. An extension reflector 12 is provided around the projection lens 93, covering the area between the front opening of the lamp body 2 and the lamp unit 5 from the front. Light L1 and L2 is the output light emitted from the first and second light source units 61 and 62, and is subjected to light distribution control by the inner lenses 91 and 92 and the reflector module 8 and emitted from the projection lens 93 towards the front of the lamp.

Figure 3:
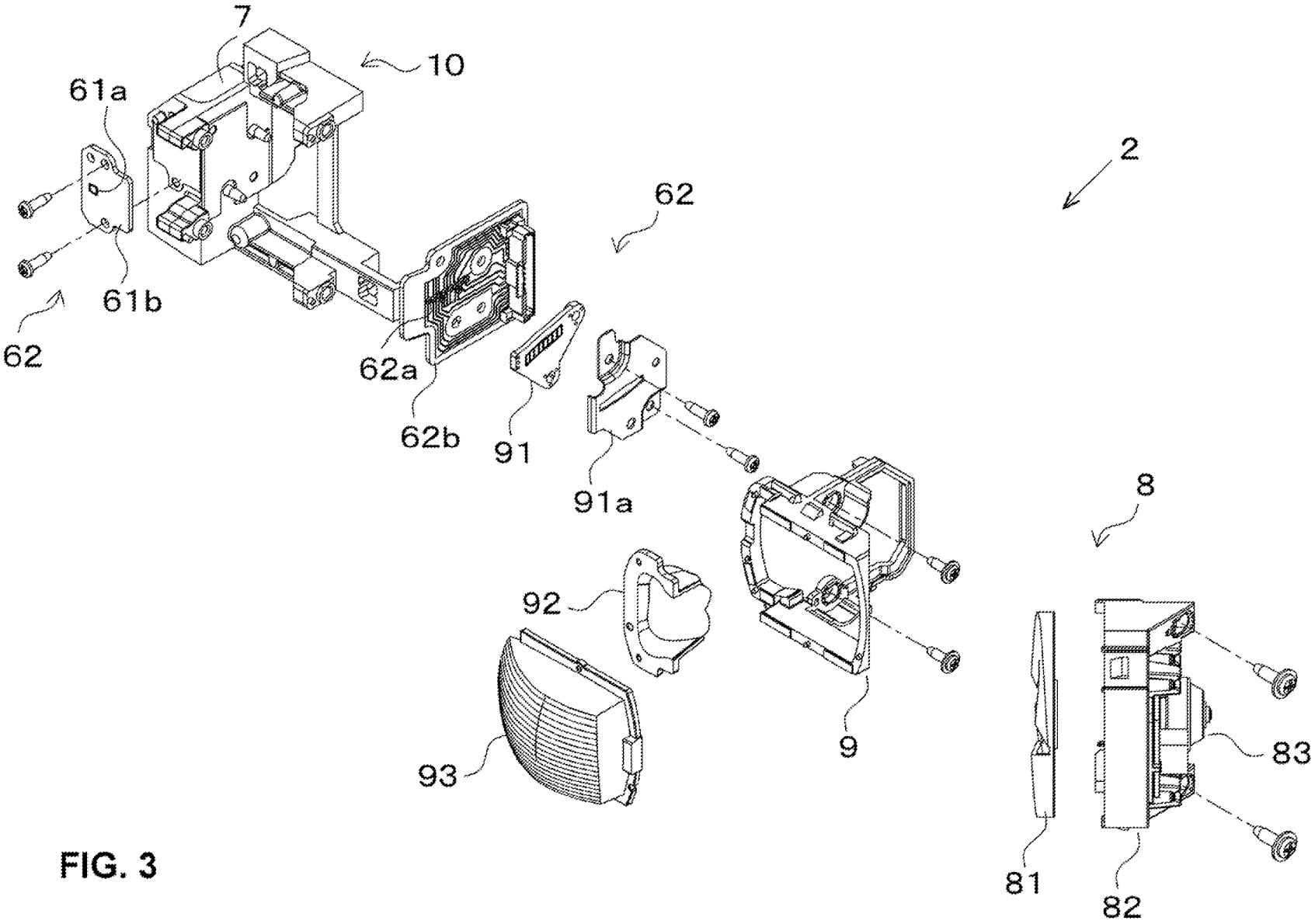
FIG. 3 is a perspective view of the lamp unit in FIG. 2.

As shown in FIG. 3, the first light source unit 61 is provided with a light source 61*a* and a substrate 61*b* on which the light source 61*a* is mounted, and the second light source unit 62 is provided with light sources 62*a* and a substrate 62*b* on which the light sources 62*a* are mounted. In addition, the reflector module 8 is provided with a rotating reflector 81 that rotates around a rotating shaft R, a reflector case 82 that holds the rotating reflector 81, and a motor 83 that drives the rotating reflector 81. The inner lens 91 is fixed to the support member 10 via the substrate 62*b* by a fixing member 91*a*. The inner lens 92 and the projection lens 93 are held to the support member 10 via a lens holder 9. Light emitting elements, such as LEDs, can be used as the first and second light sources 61*a* and 62*a*. There is no particular limitation to the number of light emitting elements in the first and second light sources 61*a* and 62*a*, and either a single or multiple elements may be used. The number may be selected so that required brightness can be generated or required on/off control can be performed according to the distance from the focal point of the projection lens, the irradiation range, the irradiation area, the light distribution pattern, the performance of the LEDs, etc. Furthermore, a plurality of light emitting elements can be arranged as an arrayed module to expand the variation of the on/off control.

Figure 4:
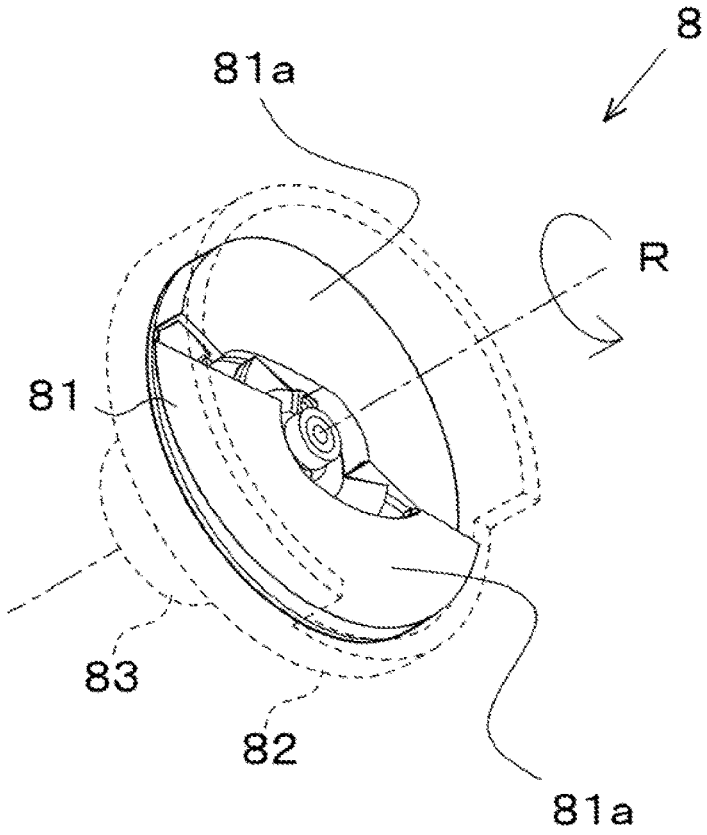
FIG. 4(*a*) shows a schematic view of a rotating reflector, and FIG. 4(*b*) shows a cross-sectional view of a reflector module.
Figure 4B:
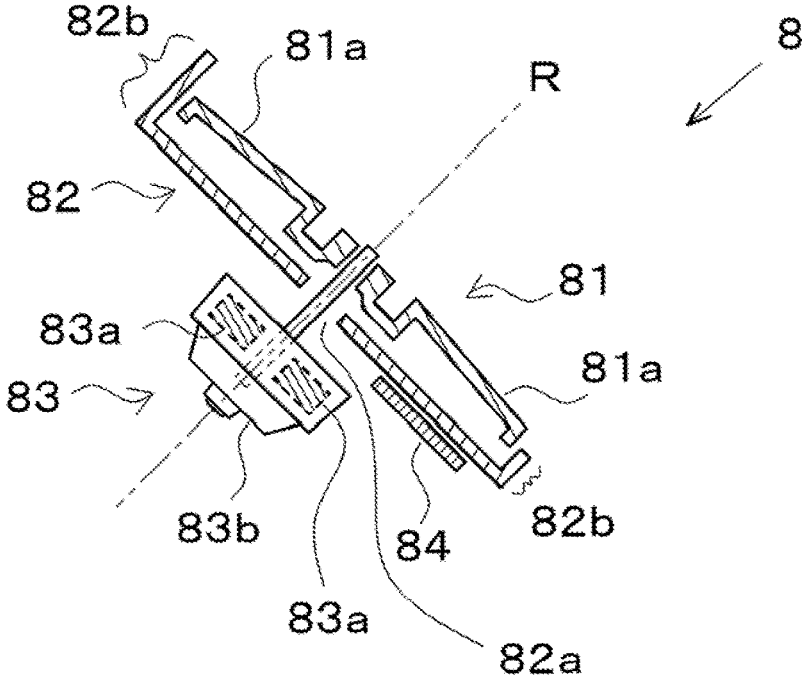

Next, the reflector module 8 will be described. As shown in FIG. 4, the reflector module 8 has a rotating reflector 81 that comprises reflective surfaces 81*a* in an approximate shape of a split disk rotatable about the rotating shaft R, the motor 83 that drives the rotating reflector 81, and the reflector case 82 that holds the rotating reflector 81. The reflector case 82 is provided with a vertical wall 82*b* that surrounds the circumference of the rotating reflector 81.

As shown in FIG. 4(*b*), the rotating reflector 81 is connected to the rotating shaft R at the center thereof, and the rotating shaft R is connected to the motor 83 through a hole 82*a* opened in the bottom of the reflector case 82. Additionally, the motor 83 includes coils 83*a* and a yoke 83*b* that rotates when energized. A control circuit board 84 that has a control circuit mounted thereon to control the motor 83 is disposed on the outer bottom surface of the reflector case 82.

The light-blocking and heat-dissipating functions of the substrates 61*b* and 62*b* will now be described based on FIGS. 5 to 7. As shown in FIG. 5, the first and second substrates 61*b* and 62*b* are mounted on two mutually non-parallel mounting surfaces 10*a* and 10*b* of the support member 10. A heat-dissipating fins 7 made of aluminum die-cast for dissipating the heat of the first and second light sources 61*a* and 62*a* are arranged at the back of the mounting surfaces 10*a* and 10*b*, forming a heat sink that includes the mounting surfaces 10*a*, 10*b* and the heat-dissipating fins 7.

FIG. 5(*b*) shows the positional relationship between the first and second light sources 61*a*, 62*a* and a light distribution control mechanism constituted by the inner lenses 91, 92, the reflector unit 8, and the projection lens 93. The light L1 emitted by the first light source 61*a* passes through the inner lens 91 to be incident upon the translucent lens 93. The light L2 emitted by the second light source 62*a*, after passing through the inner lens 92, is reflected by the reflective surfaces 8*a* of the rotating reflector 81 to be incident upon the projection lens 93. Then, the light L1 and L2 incident on the projection lens 93 is projected to the front of the lamp to form a desired light distribution pattern ahead of the vehicle.

Figure 6A:
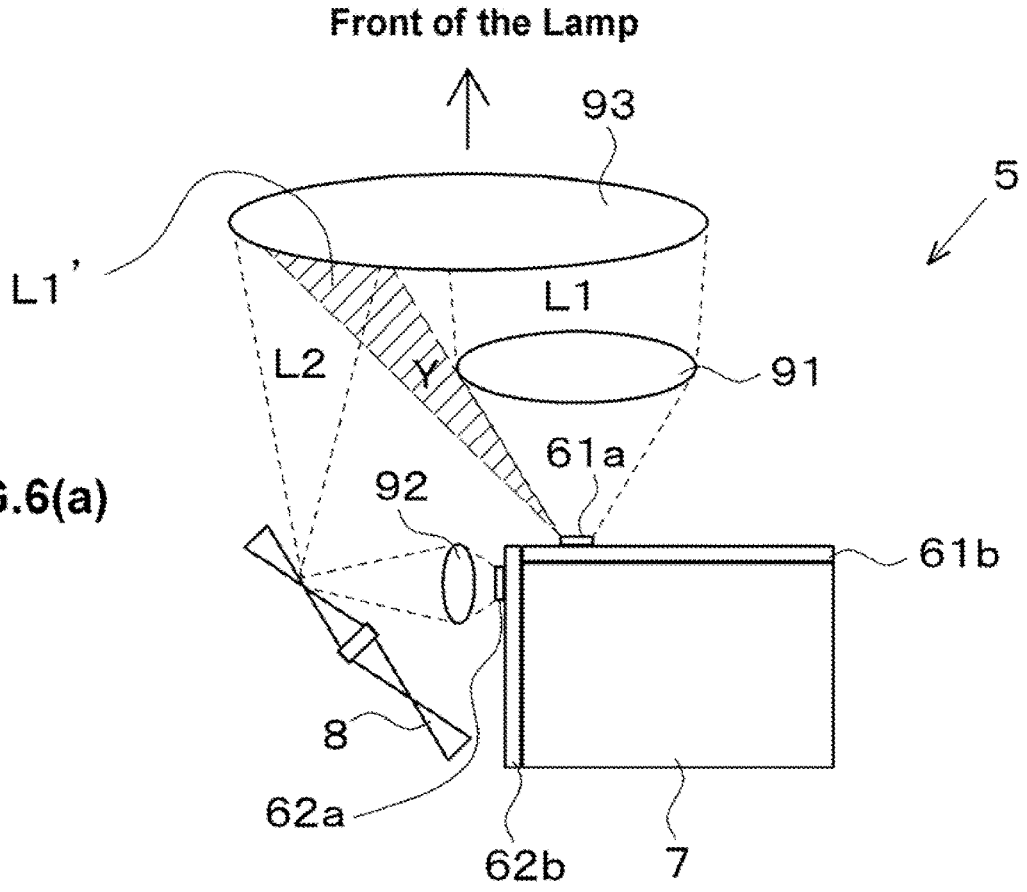
FIGS. 6(*a*) and 6(*b*) are schematic views of a conventional configuration and the configuration of the present invention, showing the positional relationship between the first and second substrates and how light is blocked by the second substrate.
Figure 6B:
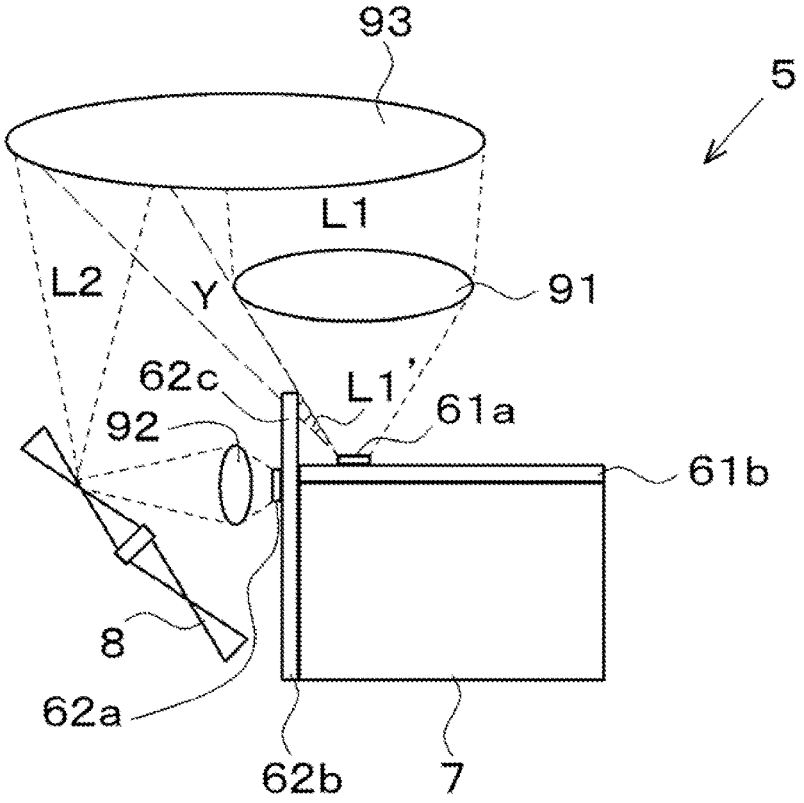

In this regard, as shown in FIG. 6(*a*), the light L1 includes light L1' that enters the range Y. The light L1' is unwanted light that enters the projection lens 93 without going through the inner lens 91, that is, without undergoing light distribution control. If such light L1' is projected forward of the vehicle, the light is likely to become glare light that disturbs the light distribution pattern.

Accordingly, in the present application, as shown in FIG. 6(*b*), the substrate 62*a* is provided with a protruding portion 62*c* that blocks a portion of the light emitted by the first light source. The protruding portion 62*c* is provided where one end of the substrate 62*b* protrudes in the direction of emission of the first light beyond the point of intersection where an extension of the substrate 61*b* intersects the substrate 62*b*. Since the protruding portion 62*c* can block the light L1' that would otherwise enter the range Y, the light L1', which does not go through the inner lens 91, can be prevented from being emitted from the projection lens 93. It should be noted that the size and the length of the protruding portion 62*c* can be changed according to the range Y where the unwanted light L1', which is desired to be blocked, occurs.

Figure 7:
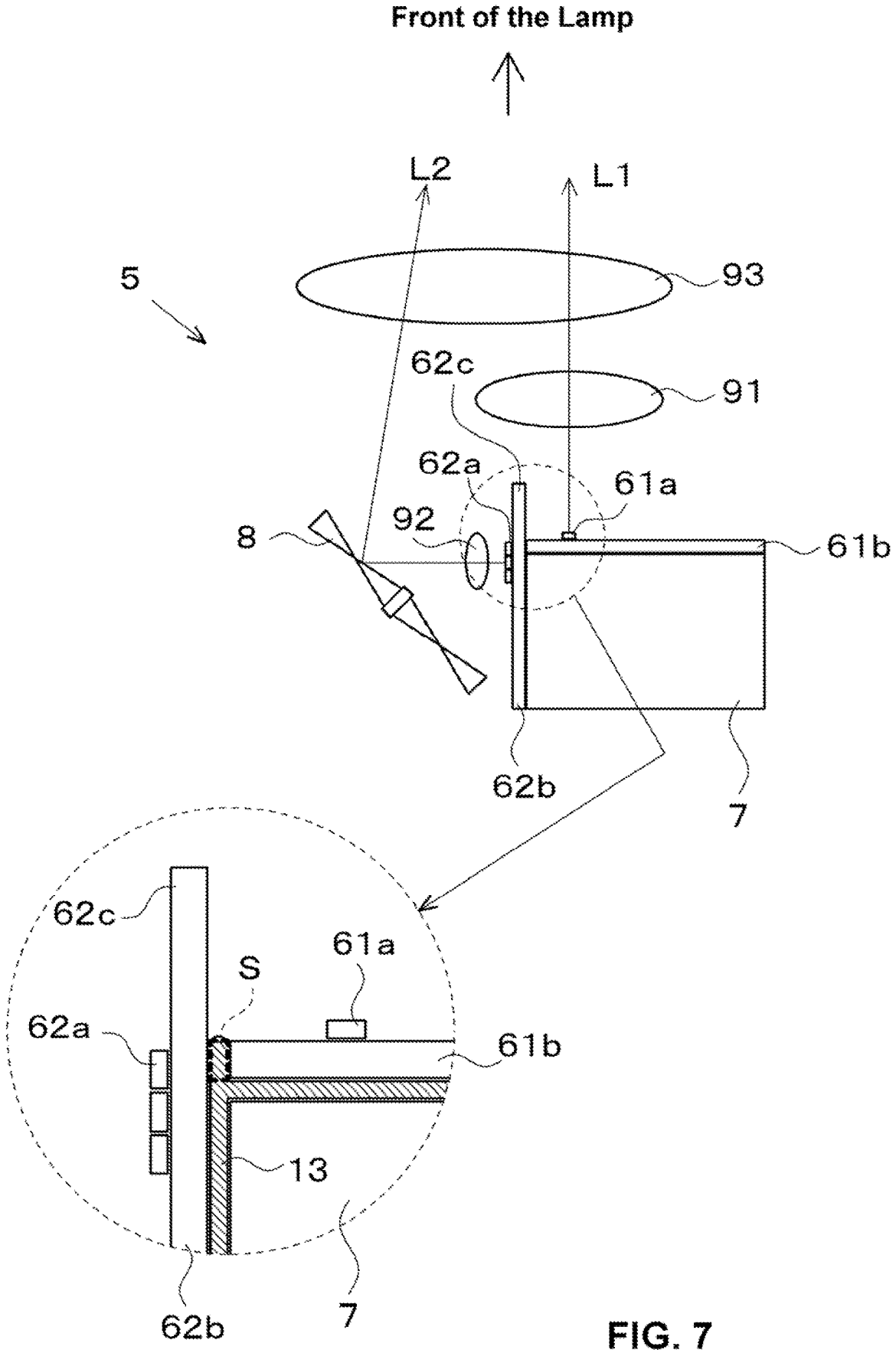
FIG. 7 is a partially enlarged view of the first and second substrates.

As shown in FIG. 7, a space S corresponding to the thickness of the substrate 61*b* is formed behind the protruding portion 62*c* between the protruding portion 62*c* and one end of the substrate 61*b*. By filling the space S with heat-dissipating grease 13, it is possible to enhance the heat-dissipating effect. In particular, even in the case where a plurality of light emitting elements that serve as the second light source 62*a* are mounted on the protruding portion 62*c* and the heat-dissipating fins 7 cannot be disposed behind the light emitting elements, it is possible to efficiently conduct heat to the heat-dissipating fins 7 via the heat-dissipating grease 13. It is also possible to use a thermally conductive sheet in place of the heat-dissipating grease 13.

According to the foregoing configuration of the vehicle lamp, as the protruding portion 62*c* is provided on the substrate 62*b* to block the unwanted light L1' with the protruding portion 62*c*, a remarkable effect is provided that enables appropriate light distribution control with a simple and compact configuration without providing an additional light blocking member. In addition, since the space S formed between the protruding portion 62*c* and the substrate 61*b* is filled with heat-dissipating grease 13 to expand the heat-dissipating range, the light source 62*a* can be placed on the protruding portion 62*c*, which has the effect of increasing the degree of freedom in the layout of the light sources 61*a* and 62*a*.

Embodiment 2

Figure 8:
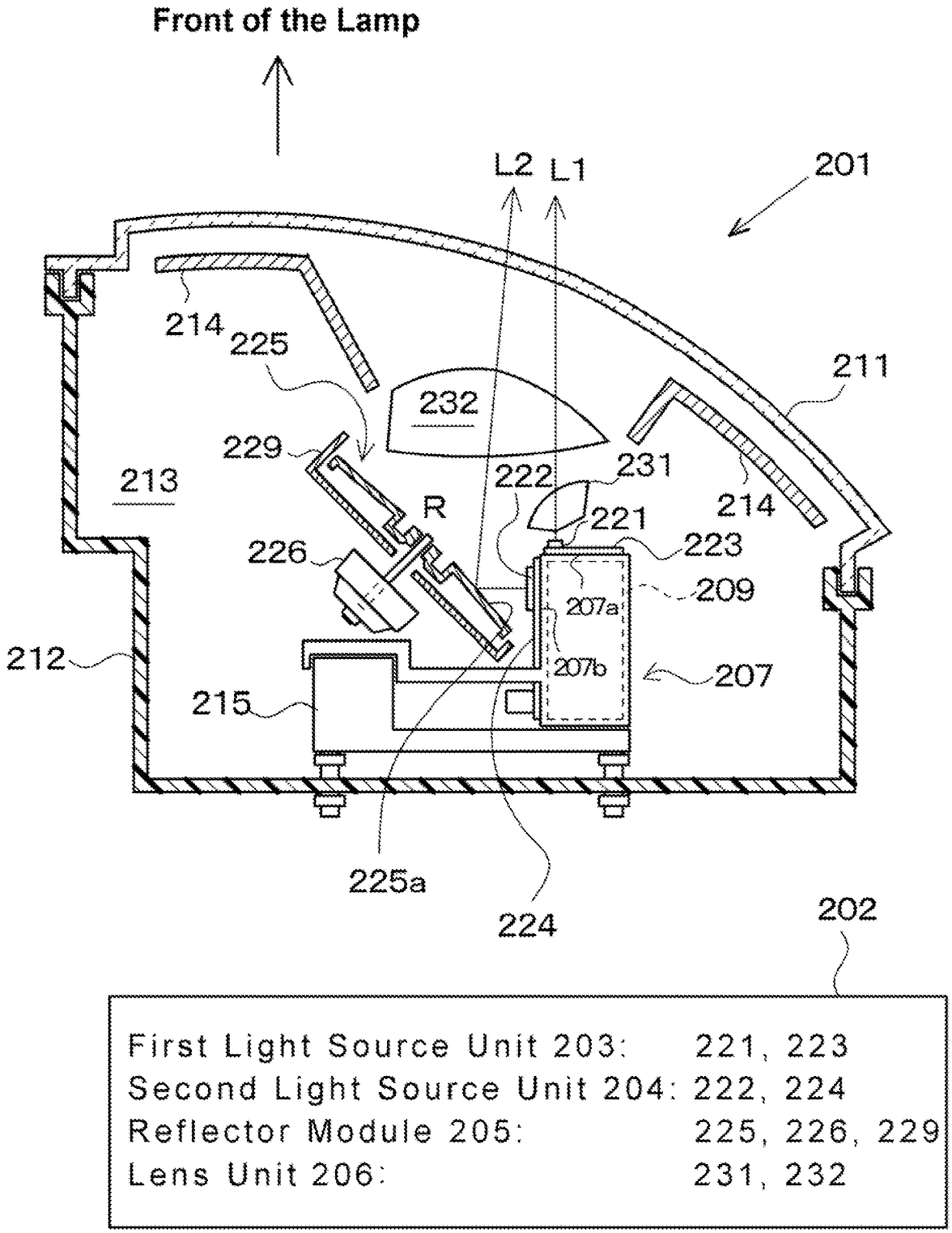
FIG. 8 is a cross-sectional view of a vehicle lamp in which a lamp unit representing Embodiment 2 of the present invention is installed.
Figure 9:
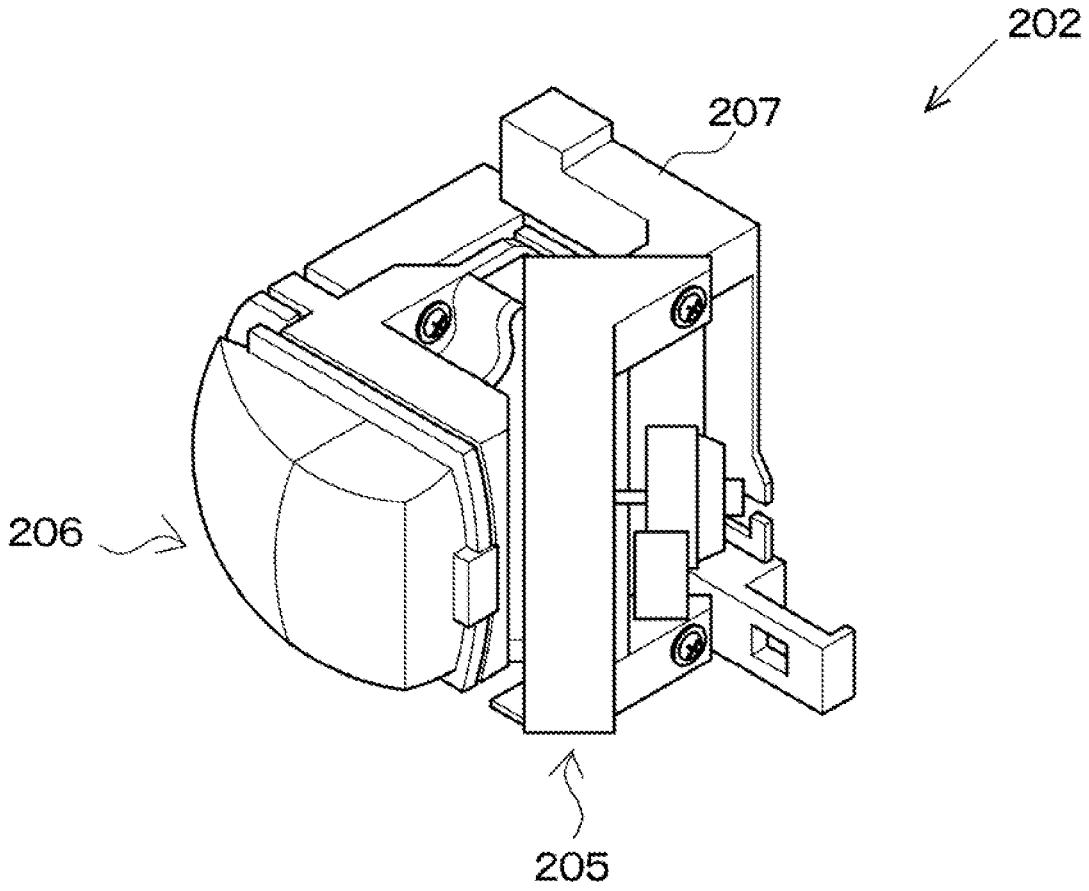
FIG. 9 is a perspective view of the lamp unit of FIG. 8.
Figure 10:
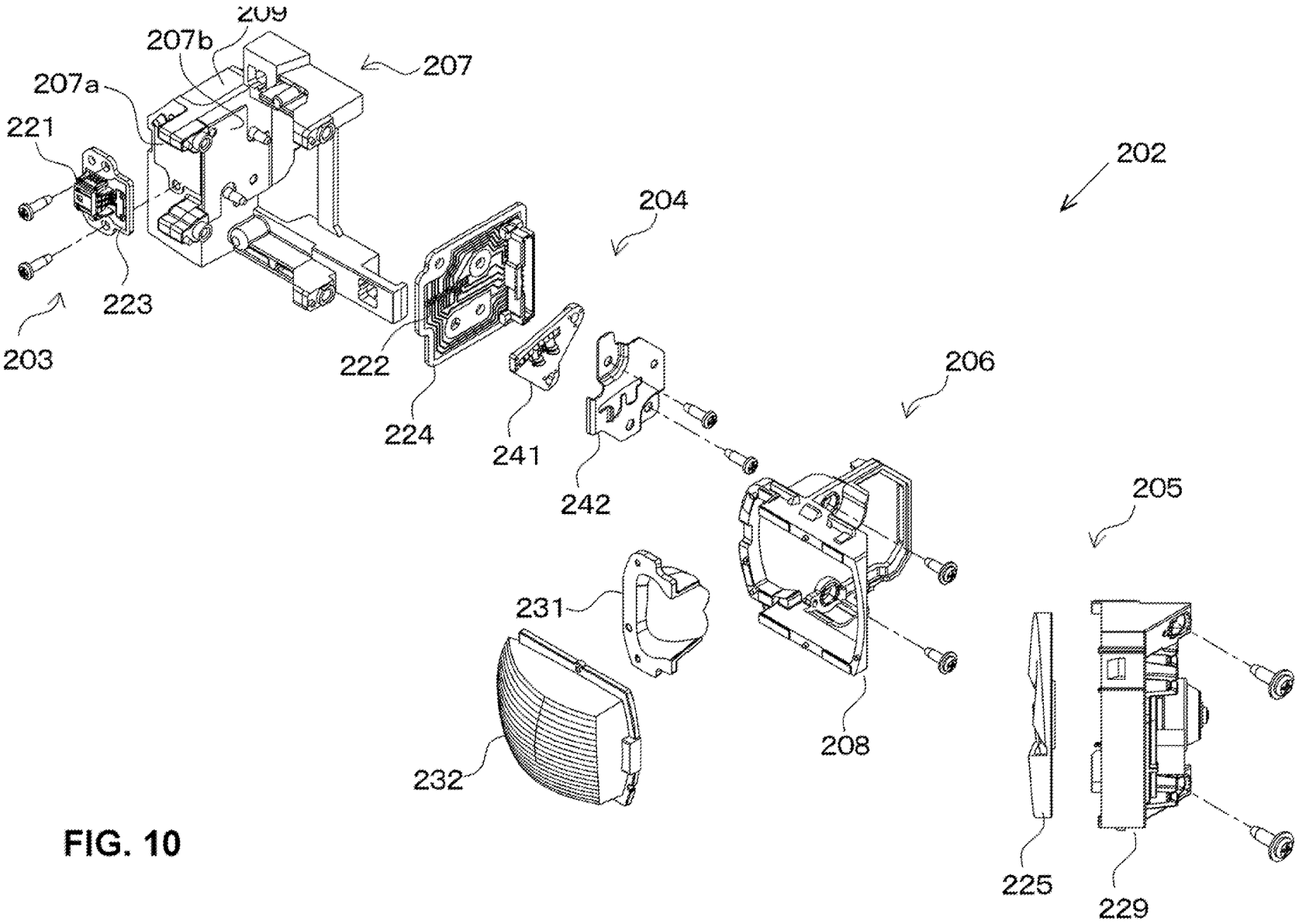
FIG. 10 is an exploded perspective view of the lamp unit of FIG. 9.

As shown in FIGS. 8-10, a lamp unit 202 of Embodiment 2 according to the present invention is disposed in the lamp chamber 213 formed between an outer lens 211 and a lamp body 212 of a vehicle lamp 201. The lamp unit 202 is comprised of first and second light source units 203 and 204, a reflector module 205, and a lens unit 206. Additionally, an extension 214 is provided inside the lamp chamber 213 to shield a part of the lamp unit 202 from the front of the lamp.

The lamp unit 202 is also provided with a support member 207. The support member 207 supports the first and second light source units 203 and 204, the reflector module 205, and the lens unit 206, and also has a heat sink 209 behind the mounting surfaces 207*a* and 207*b* on which the first and second light source units 203 and 204 are mounted so as to dissipate the heat generated by the first and second light source units 203 and 204. The support member 207 is held to the lamp body 212 by an aiming adjustment member 215.

The first light source unit 203 is provided with a light emitting element 221 and a substrate 223 on which the light emitting elements 221 is mounted, and the second light source unit 204 is provided with light emitting elements 222 and a substrate 224 on which the light emitting elements 222 are mounted. The reflector module 205 is provided with a rotating reflector 225 that rotates around a rotating shaft R, a reflector case 229 that holds the rotating reflector 225, and a motor 226 that drives the rotating reflector 225. The lens unit 206 is provided with first and second lenses 231 and 232 and a lens holder 208 that holds the first and second lenses 231 and 232.

The light L1 emitted from the light emitting element 221 is transmitted through the first lens 231 and enters the second lens 232. On the other hand, the light L2 emitted from the second light source unit 204 is reflected by the reflective surfaces 225*a* of the rotating reflector 225 and enters the second lens 232. The light L1 and L2 of the first and second light source units incident on the second lens 232 is projected in front of the lamp to form a desired light distribution pattern. In order to direct the direct light L1 and the light L2 reflected off the rotating reflector to the second lens 232, the substrates 223 and 224 are provided in a non-parallel manner.

Figure 11A:
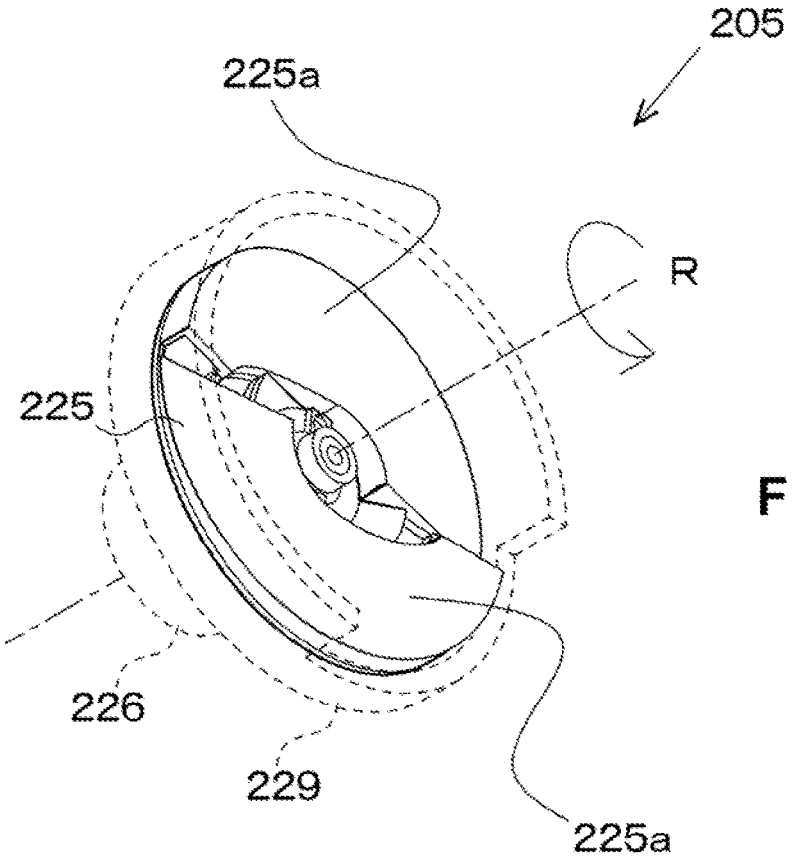
FIG. 11 is a schematic view of a reflector module.
Figure 11B:
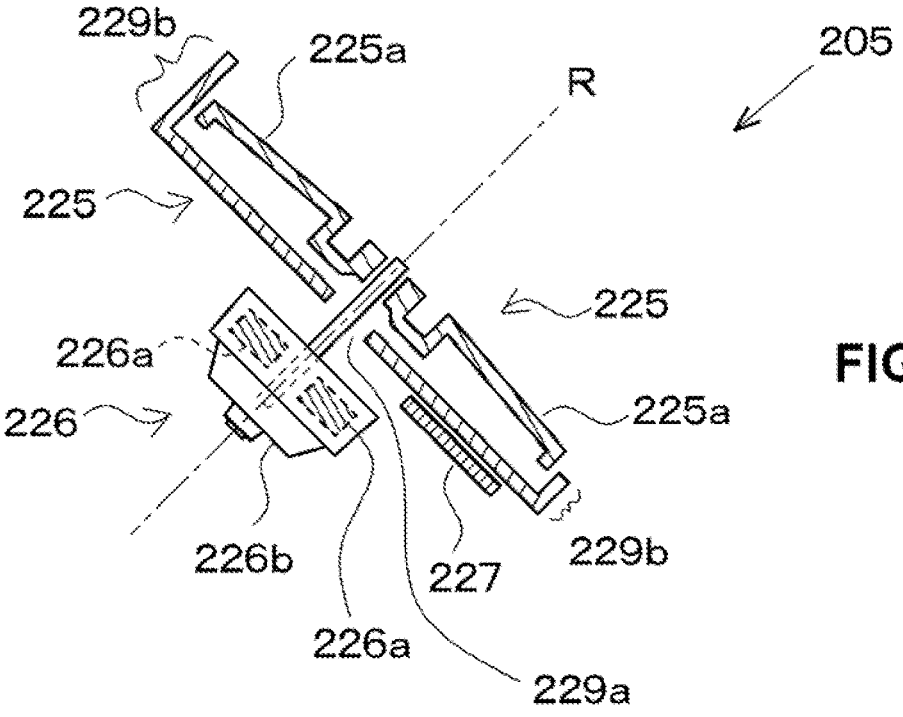

As shown in FIG. 11, the reflector module 205 includes the rotating reflector 225, which comprises the reflective surfaces 225*a* in an approximate shape of a split disk that are rotatable about the rotating shaft R, the motor 226, which drives the rotating reflector 225, and the reflector case 229, which holds the rotating reflector 225. The reflector case 229 has a vertical wall 229*b* surrounding the circumference of the rotating reflector 225.

As shown in FIG. 11(*b*), the rotary reflector 225 is connected to the rotating shaft R at the center thereof, and the rotating shaft R is connected to the motor 226 through a hole 229*a* opened in the bottom of the reflector case 229. Additionally, the motor 226 includes coils 226*a* and a yoke 226*b* that rotates when energized. A control circuit board 227 that has a control circuit mounted thereon to control the motor 226 is disposed on the outer bottom surface of the reflector case 229.

Figure 12:
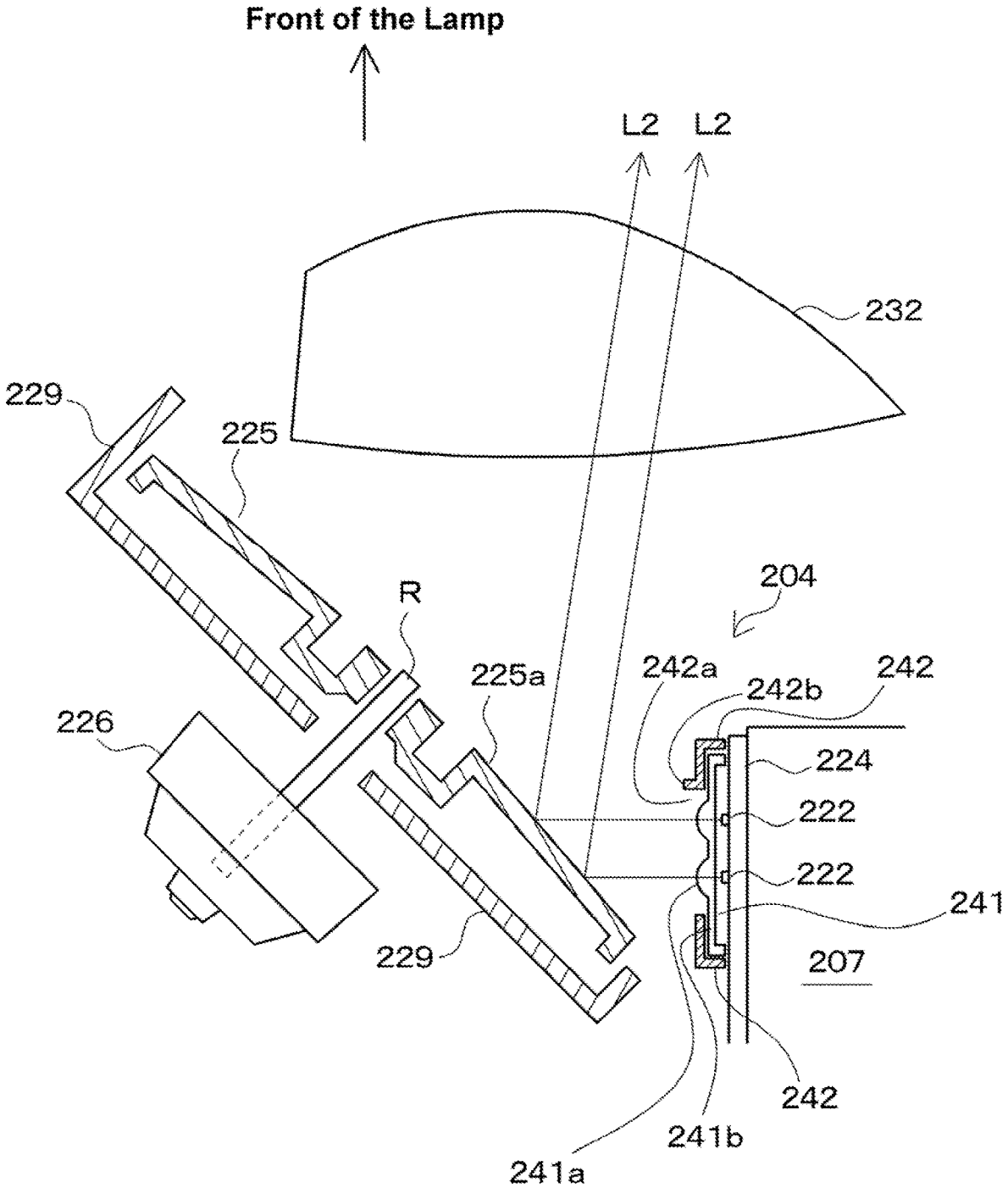
FIG. 12 is a partially enlarged view of the lamp unit of FIG. 8, focusing on the fixing member.
Figure 13:
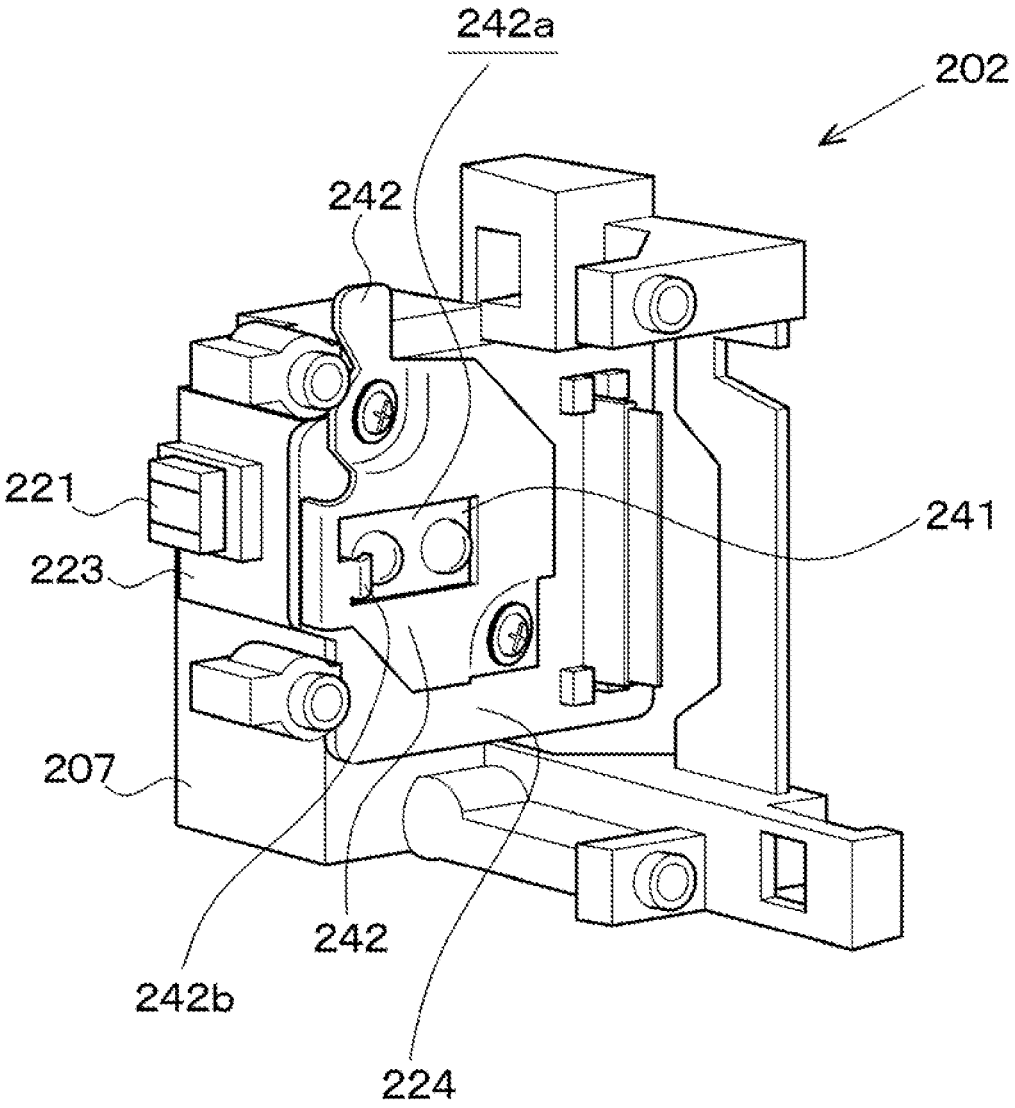
FIG. 13 is a perspective view showing how substrates, light emitting elements, and a fixing member are screwed to a support member.
Figure 14:
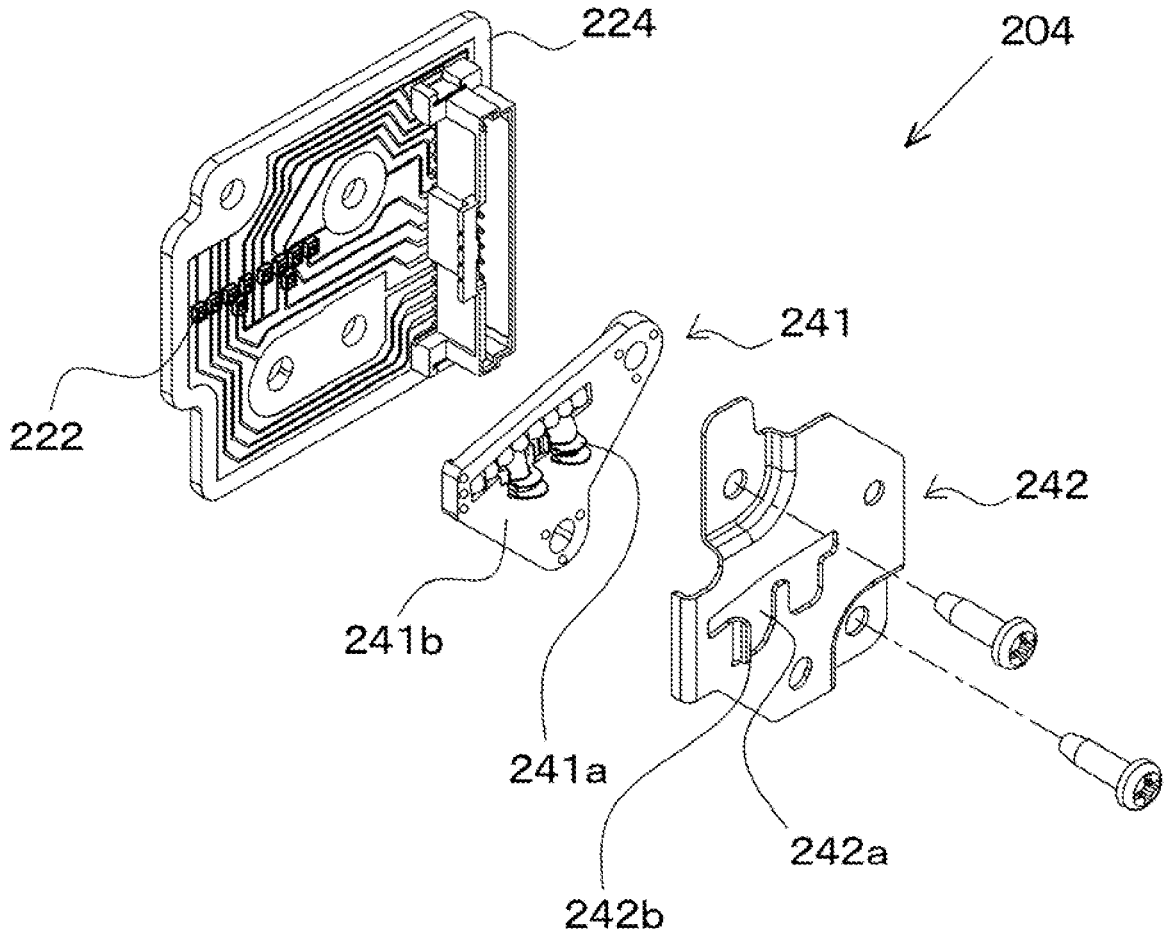
FIG. 14 is an exploded perspective view of a substrate, light emitting elements, and the fixing member of FIG. 13.

As shown in FIGS. 12-14, the second light source unit 204 has, in addition to the light emitting elements 222 and the substrate 224, a cover lens 241 that transmits light from the light emitting elements 222, and a fixing member 242 that secures the cover lens 241 to the substrate 224. It should be noted that the fixing member also serves to prevent the cover lens 241 from being warped.

As shown in FIG. 12, the cover lens 241 is provided between the light emitting elements 222 and the reflective surfaces 225*a* of the rotating reflector 225. The cover lens 241 comprises a light distribution control portion 241*a* that projects light emitted from the light emitting elements 222 onto the reflective surfaces 225*a* of the rotating reflector 225, and a leg portion 242*b* that supports the light distribution control portion 241*a* on the substrate 224, and is integrally molded as a transparent member.

The opening 242*a* of the fixing member 242 is formed so as to expose the light distribution control portion 241*a*, and a standing wall 242*b* is provided on a peripheral edge of the opening 242*a* so as to block the space between the second lens 232 and the cover lens 241.

Figure 15:
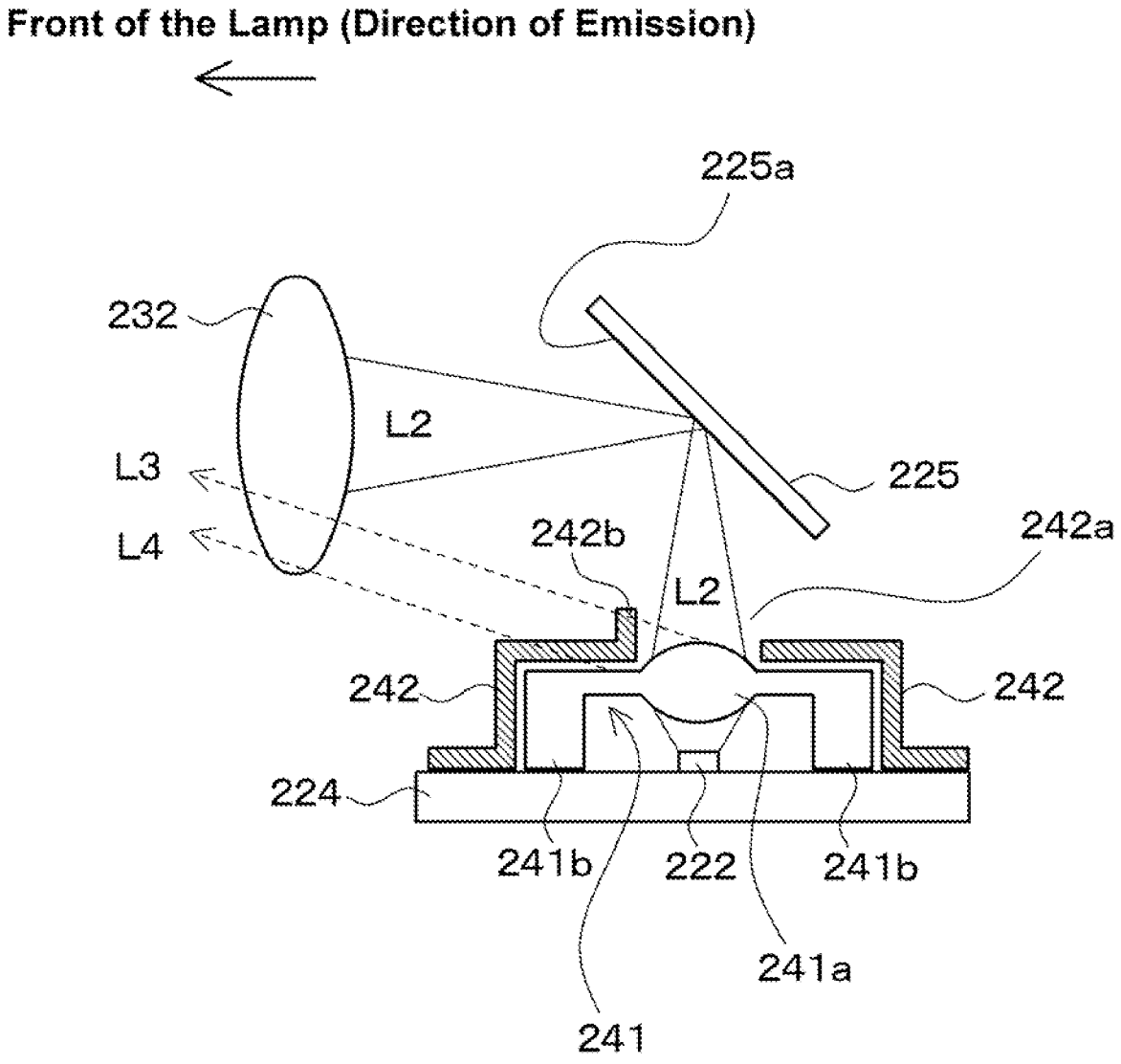
FIG. 15 is a schematic diagram showing the light shielding effect of the fixing member.

FIG. 15 is a schematic diagram that shows the light shielding effect of the fixing member. The light emitted from the light emitting elements 222 is first incident on the cover lens 241. Light, such as the light L2, emitted from the light distribution control portion 241*a* of the cover lens 241 and directed to the second lens 232 via the reflective surfaces 225*a* of the rotating reflector 225, is effective light that is properly controlled and forms a desired light distribution pattern in front of the lamp.

Conversely, the light L4 emitted from the leg portion 242*b* of the cover lens 241 and the light L3 traveling directly towards the second lens 232, not by way of the rotating reflector 225 after being emitted from the light distribution control unit 241*a*, is uncontrolled, unwanted light and would not form the desired light distribution pattern. Otherwise, it would interfere with the formation of the light distribution pattern by light L2.

In this case, the fixing member 242 covers the cover lens 241, exposes the light distribution control portion 241*a* through the opening 242*a*, and has the vertical wall 242*b* on a peripheral edge of the opening 242*a*, in particular, on the side where the second lens 232 is located. As a result, the light L4 is blocked by the fixing member 242, and the light L3 is blocked by the vertical wall 242*b*. As a result, only the controlled light L2 and the light L1 from the first light source unit 203 (see FIG. 8) is incident on the second lens 232 so as to enable projection of the desired light distribution pattern. Preferably, the vertical wall 242*b* has a sufficient height to isolate the light distribution control portion 241*a* from the second lens 232 and to prevent light exiting the light distribution control portion 241*a* from directly entering the second lens 232.

The lamp unit 202 configured as above has the effect of being able to project only the control light L2 because the uncontrolled light L3, L4 exiting the cover lens 241 is blocked by the fixing member 242 and the vertical wall provided on the fixing member 242. As an additional effect, the number of parts of the lamp unit 202 can be reduced and the size of the lamp unit 202 can be made smaller as the fixing member 242, which is an existing member, is modified for the use.

Embodiment 3

Figure 16:
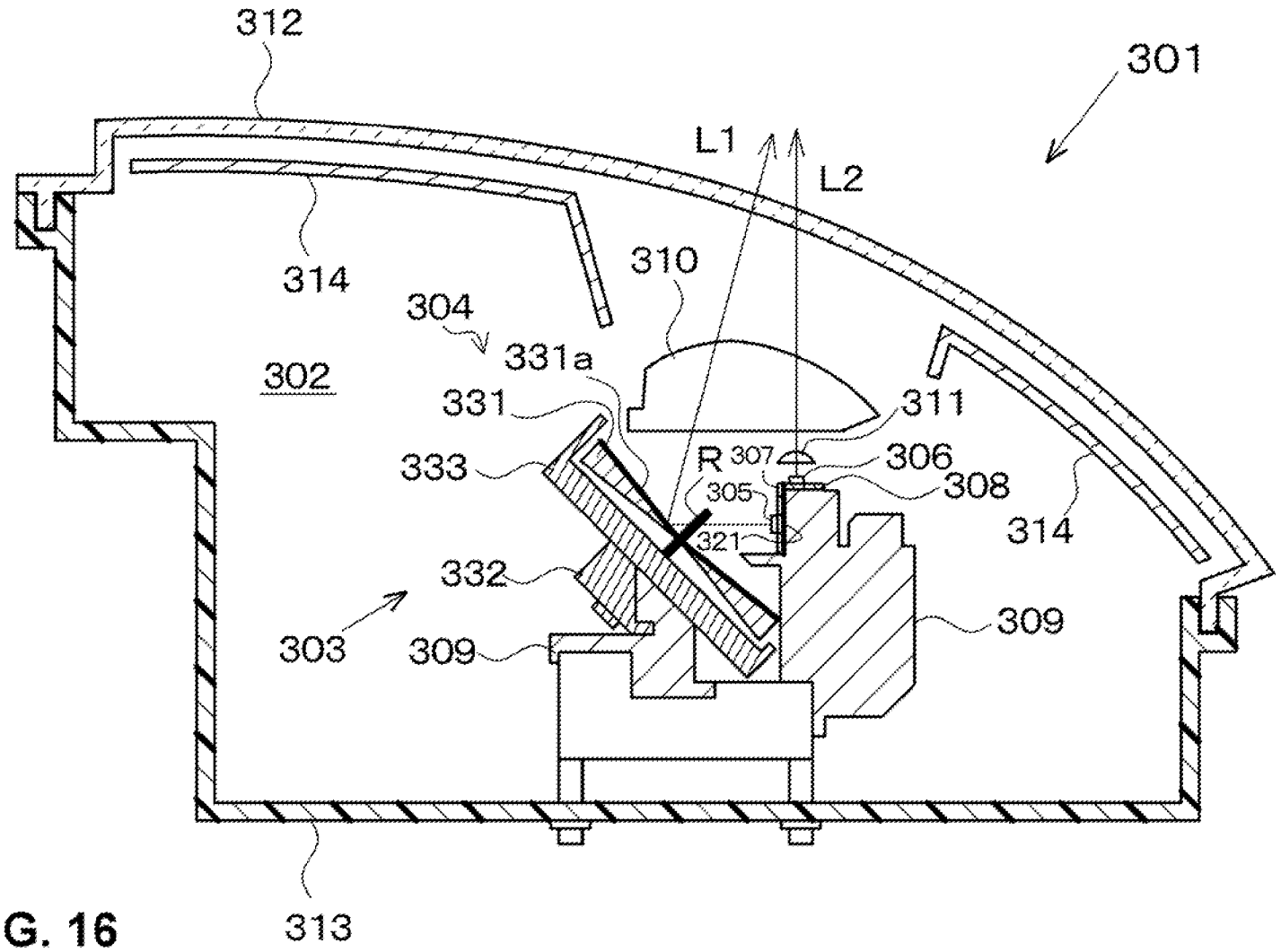
FIG. 16 is a cross-sectional view of a vehicle lamp in which a lamp unit representing Embodiment 3 of the present invention is installed.
Figure 17:
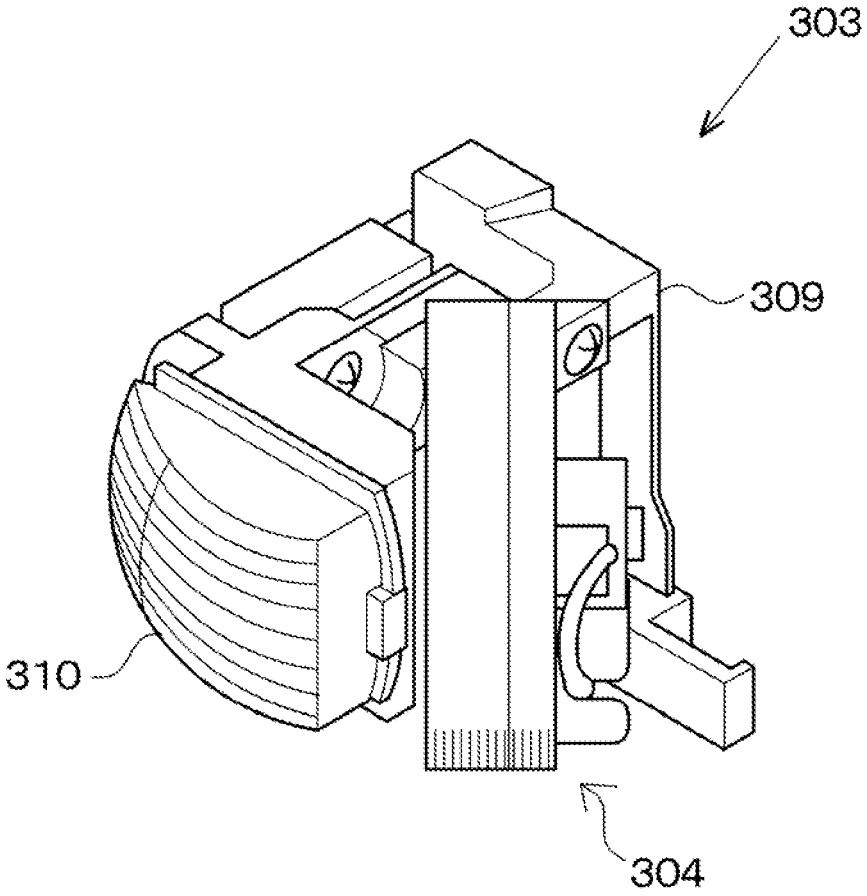
FIG. 17 is a perspective view of the lamp unit of FIG. 16 as seen from the front of the vehicle.

As shown in FIGS. 16 and 17, a lamp unit 303 of Embodiment 3 according to the present invention is disposed in a lamp chamber 302 formed by an outer lens 312 and a lamp body 313 of a vehicle lamp 301, and is comprised of a reflector module 304 that includes a rotating reflector 331, a light emitting element substrate 307 that mounts light emitting elements 305 that emit light onto reflective surfaces 331*a* of the rotating reflector 331, a support member 309 having a mounting surface 321 on which the light emitting element substrate 307 is mounted, and a projection lens 310 that projects the light L1 reflected by the reflective surfaces 331*a* to the front of the lamp.

It should be noted that the lamp unit 303 is mounted in a predetermined position on the lamp body 313 in a manner that enables aim control, and a part of the lamp unit 303 is shielded from the outside of the vehicle lamp 1 by an extension 314.

The support member 309 supports the light emitting element substrate 307 so that the light from the light emitting elements 305 is directed to the rotating reflector 331, and also supports the reflector module 304 in a position where the rotating shaft R of the rotating reflector 331 is inclined with respect to the mounting surface 321. A light emitting element substrate 308 on which a light emitting element 306 is mounted is also set on the support member 309. The light L2 emitted from the light emitting element 306 is projected out of the vehicle via the inner lens 311 and the projection lens 310 without being routed by way of the rotating reflector 331. In the vicinity of the light emitting element substrates 307 and 308, a heat sink (not shown) is disposed to dissipate the heat generated by the light emitting elements 305 and 306.

Figure 19A:
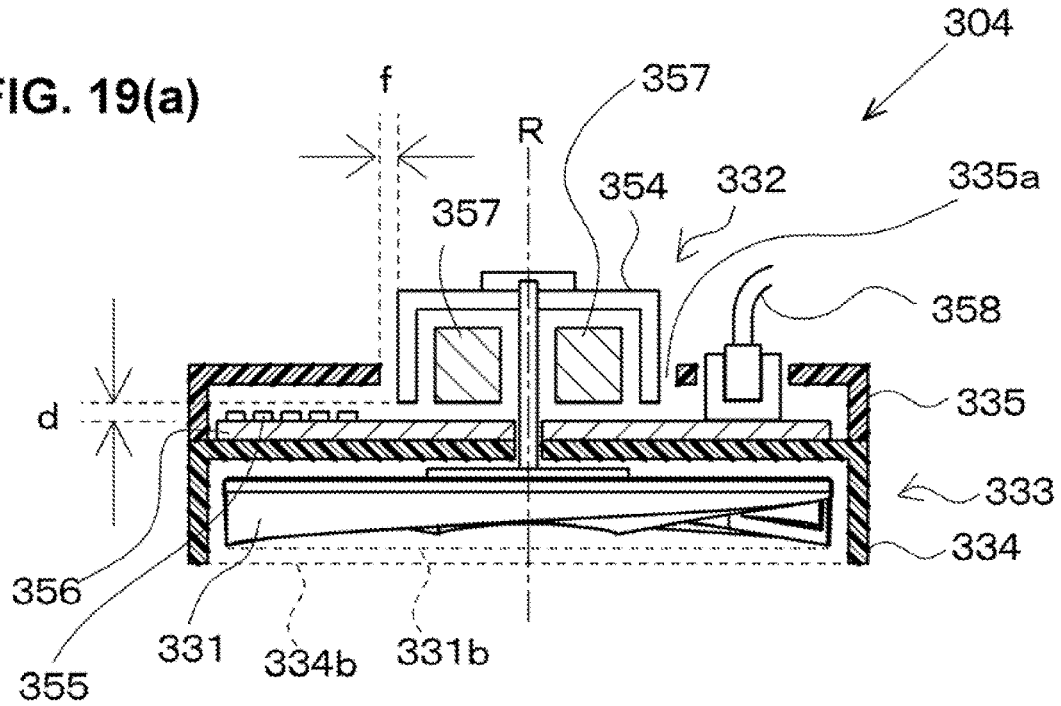
FIG. 19(*a*) is a cross-sectional view of the reflector module taken on line A-A, and FIG. 19(*b*) is an exploded perspective view thereof.
Figure 19B:
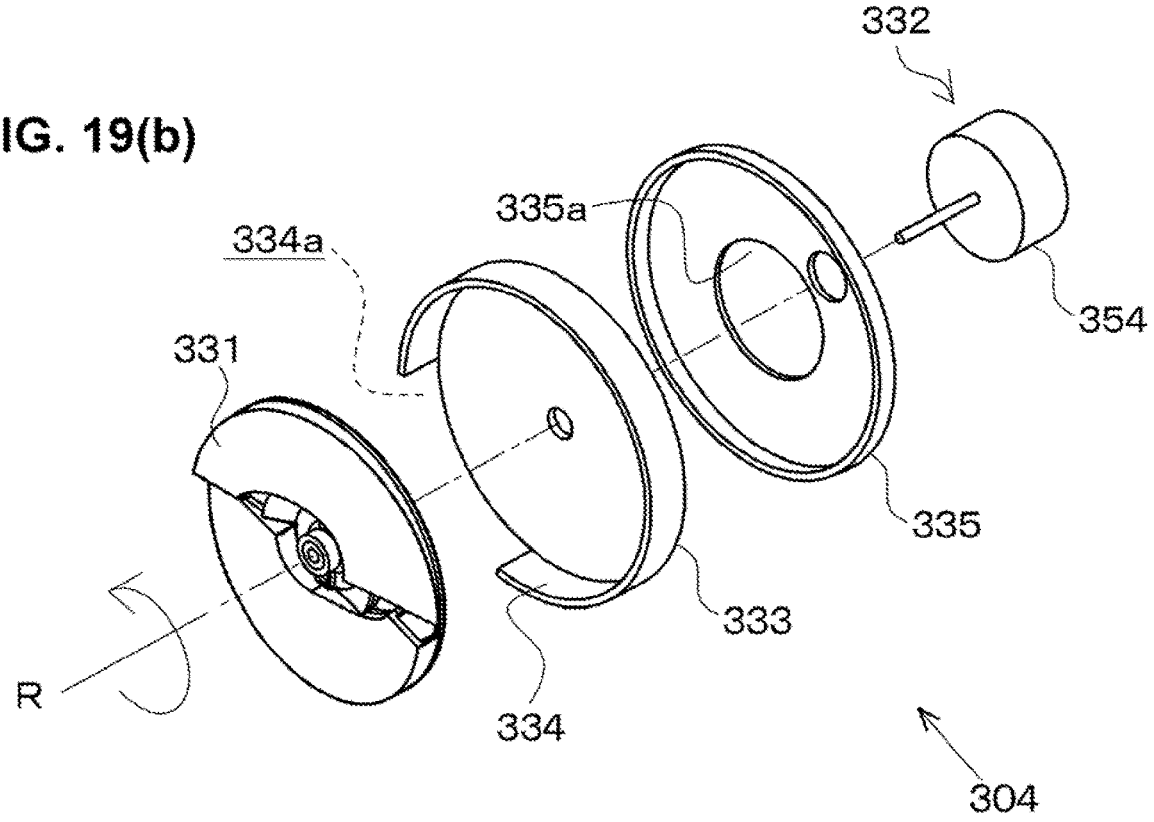

As shown in FIGS. 18 and 19, the reflector module 304 has a rotating reflector 331 that has reflective surfaces 331*a* on the front side 331*b* of the rotating reflector 331, a case 333 that contains the rotating reflector 331, a motor 332 on the back side of the rotating reflector 331 to rotate the rotating reflector 331 about the rotating shaft R, and a cover 335 on the outer bottom surface of the case 333.

As shown in FIG. 18(*c*), the rotating reflector 331 is comprised of blades 351 formed in an approximate shape of a split disk as seen in a front view, and the center portion of the approximate split disk of the blades 351 is cut out so that each blade gradually decreases from one radial edge to the other. As shown in FIG. 19(*a*), the reflective surfaces of the blades 351 are inclined in a gentle arc so that the thickness decreases from the rim portion at the larger radial edge to the rim portion at the smaller radial edge as seen in a side view.

The present application employs a blade scan method that utilizes these inclined reflective surfaces 331*a* of the blades 351. The blade scan method is a technology that controls the lighting of the light emitting elements 305 only while the blades 351 rotate between predetermined rotation angles, and forms a desired light distribution pattern by using the effect of the gradual change in the projection direction of the reflected light according to the gradual inclination of the reflective surfaces 331*a* of the blades 351. The light distribution pattern is controlled according to the traffic conditions. For example, vehicle-mounted sensors are used to detect the presence or absence of a vehicle ahead, an oncoming vehicle, or a pedestrian, and the light distribution pattern is adjusted to properly notify each vehicle or pedestrian of the presence of the own vehicle. This technology is known as ADB (Adaptive Driving Beam).

As shown in FIG. 19(*a*), a vertical wall 334 is provided along the periphery of the inner bottom surface of the case 333 to enclose the outer peripheral surface of the rotating reflector 331. The height of the vertical wall 334 is preferably set so that front side 331*b* of the rotating reflector 331 are contained further inward than the plane 334*b* defined by the top end of the vertical wall 334.

The motor 332 includes a motor drive unit. The motor drive unit is comprised of a yoke portion 354, coils 357, and a control circuit board 356 that has a control circuit 355 installed thereon that controls the yoke portion 354 and the coils 357. A cover 335 is provided on the outer bottom surface of the case 333 to cover the control circuit board 356.

The cover 335 should be provided to the extent that it covers at least part of the motor drive unit while exposing at least part of the yoke portion 354. For example, as shown in FIG. 19(*a*), it is preferred that the gap d formed between the yoke portion 354 and the control circuit board 356 is not exposed through the opening 335*a*. In this case, even if the harness 358 moves toward the yoke portion 354 due to vibration, the risk of entanglement can be reduced because the gap d is covered. It may also be preferably selected to provide a gap f between the opening 335*a* of the cover 335 and the yoke portion 354. In this case, the rotation of the yoke portion 354 causes airflow toward the inside/outside of the cover 335 so as to enable the cooling of the control circuit board 356.

The vertical wall 334 of the case 333 has a cutout 334*a* in one portion thereof, and is configured to have a partially lower height. The cutout 334*a* prevents interference between the case 333 and the support member 309 of the lamp unit 343, and enables the reflector module 304 to be safely and stably assembled to the lamp unit 303.

Figure 20A:
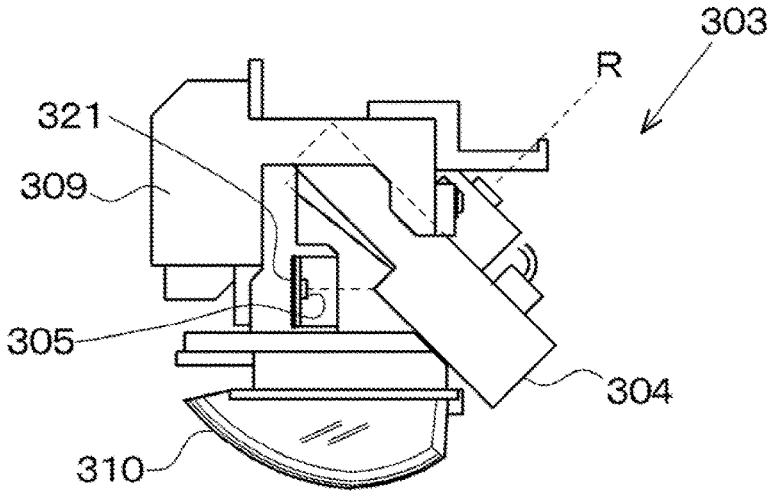
FIG. 20(*a*) is a plan view of the lamp unit as seen from above the vehicle lamp, and FIG. 20(*b*) is a plan view showing the reflector module of the plan view of FIG. 20(*a*) detached.
Figure 20B:
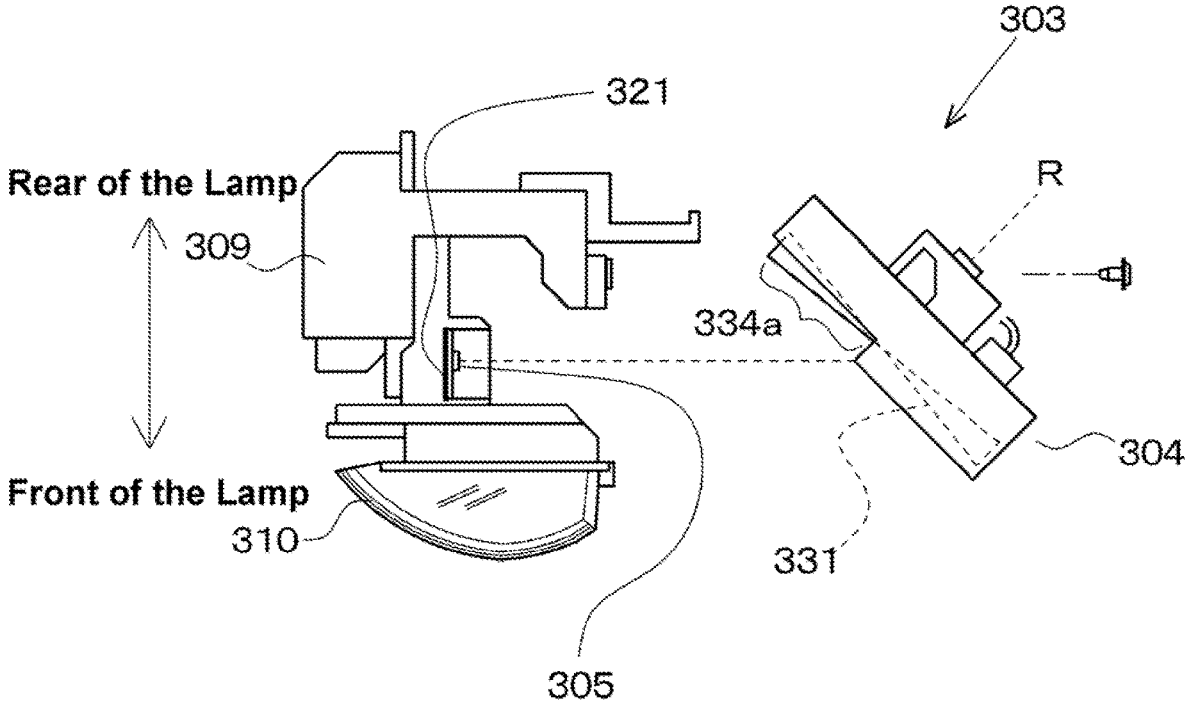

FIG. 20(*a*) is a plan view of the lamp unit 303 viewed from above the vehicle lamp 301, and FIG. 20(*b*) is a view of the reflector module 304 laterally detached from the lamp unit 303 of FIG. 20(*a*). As shown in FIG. 20(*b*), it is preferred that the cutout 334*a* in the vertical wall 334 of the case 333 be positioned rear of the light emitting elements 305 in the vehicle lamp 301, in particular. In addition, the cutout 334*a* can be shaped to surround the rotating reflector 331 as extensively as possible while avoiding interference with the support member 309; for example, a recess may be provided that is lower than the surrounding area, or a recess may be provided to conform to the shape of the support member 309.

Figure 21A:
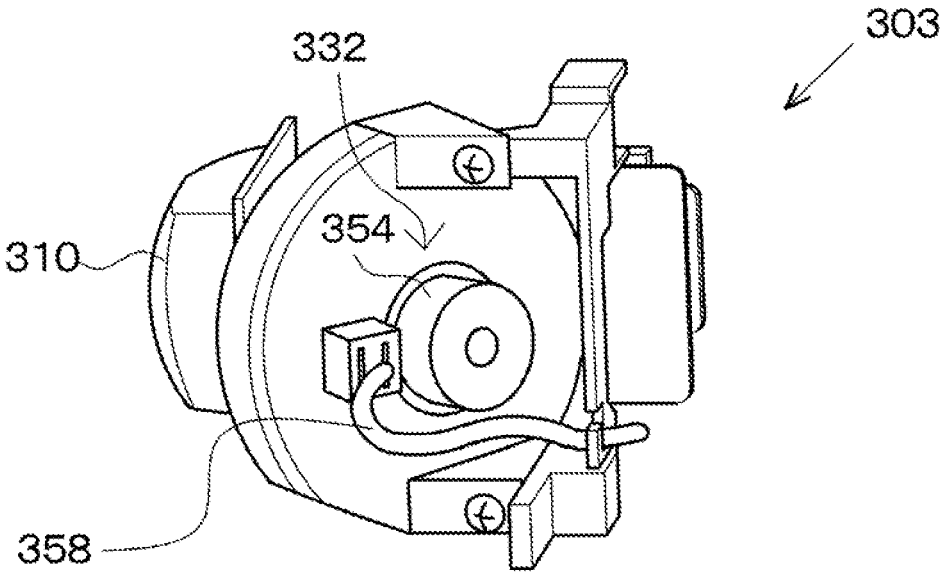
FIG. 21 is a perspective view of the lamp unit of FIG. 16 as seen from the rear of the vehicle.
Figure 21B:
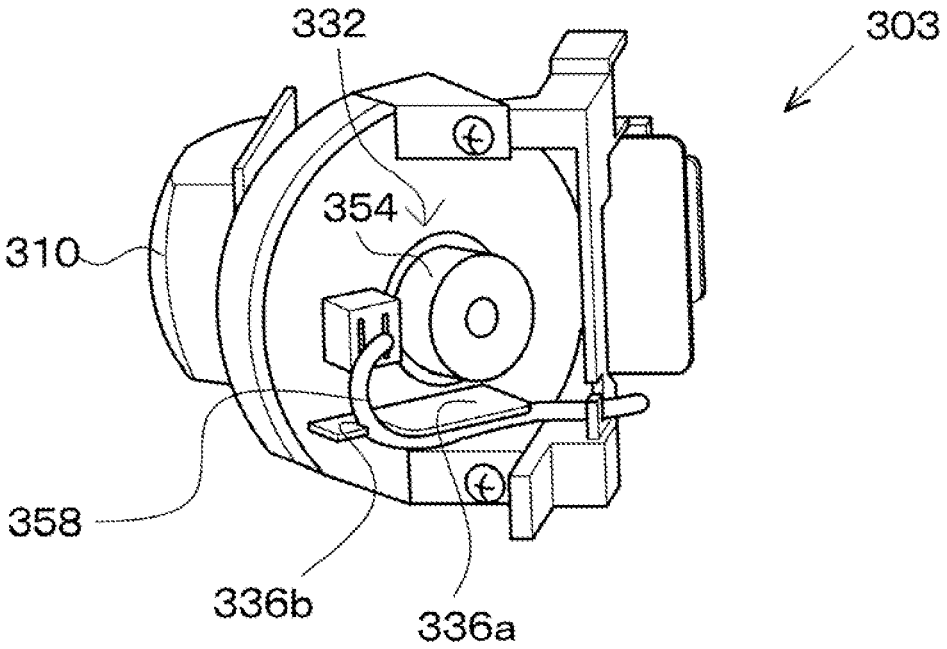

FIG. 21 is a perspective view of a lamp unit 303 as viewed from the rear of the vehicle lamp 301, in which FIG. 21(*a*) shows a conventional configuration, and FIG. 21(*b*) shows the configuration of this embodiment. As shown in FIG. 20(*b*), in this embodiment, a retainer member 336 is provided on the outer bottom surface of the cover 335 to retain the harness 358, which serves as a wiring member used to supply power to the motor 332, in a predetermined position. The retainer member 336 is provided with a shielding wall 336*a* that shields the harness 358 and the yoke portion 354 from coming into contact with each other, and a portion of the shielding wall 336*a* can be configured to include an engaging portion 336*b* that supports the harness 358 from both sides thereof.

According to the reflector module 304 and lamp unit 303 configured as above, as a case 333 is provided for the rotating reflector 331, and a vertical wall 334 surrounding the rotating reflector 331 is provided at the inner periphery of the bottom surface of the case 333, an effect is provided that safely prevents its contact with other components placed in close proximity to the reflector module 304. In addition, when assembling the reflector module 304 to the retainer member 336, it is possible to manually hold the case 333 during the assembling work, which effectively allows this work to be done without contaminating the reflective surface 331*a* of the rotating reflector 331.

As a cover 335 covering the control circuit board 356 is provided on the back side of the case 333, and a retainer member 336 holding the harness 358 is provided on the outer bottom surface of the cover 335, the control circuit board 356 can be effectively protected from the outside while preventing contact between the yoke 354, which is a rotating body, and the harness 358.

Furthermore, since the vertical wall 334 of the case 333, especially in the portion thereof located rear of the light emitting elements 305 in the lamp, is provided with a cutout 334*a* so that part of the vertical wall is lower, it is possible to stably and safely assemble the reflector module 304 to the lamp unit 303 while avoiding interference between the support member 309 and the vertical wall 334.

Embodiment 4

Figure 22:
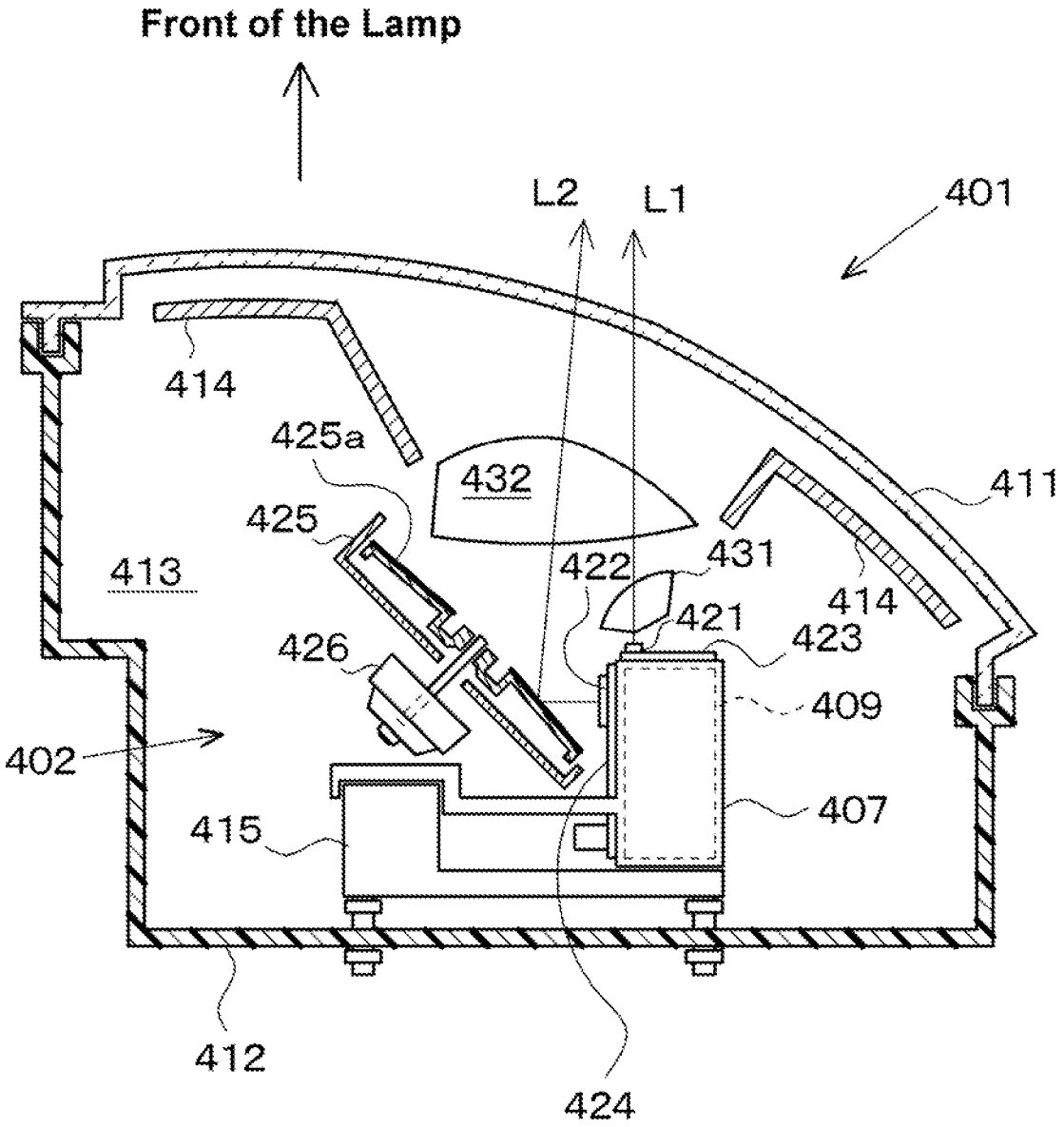
FIG. 22 is a cross-sectional view of a vehicle lamp in which a lamp unit representing Embodiment 4 of the present invention is installed.
Figure 23:
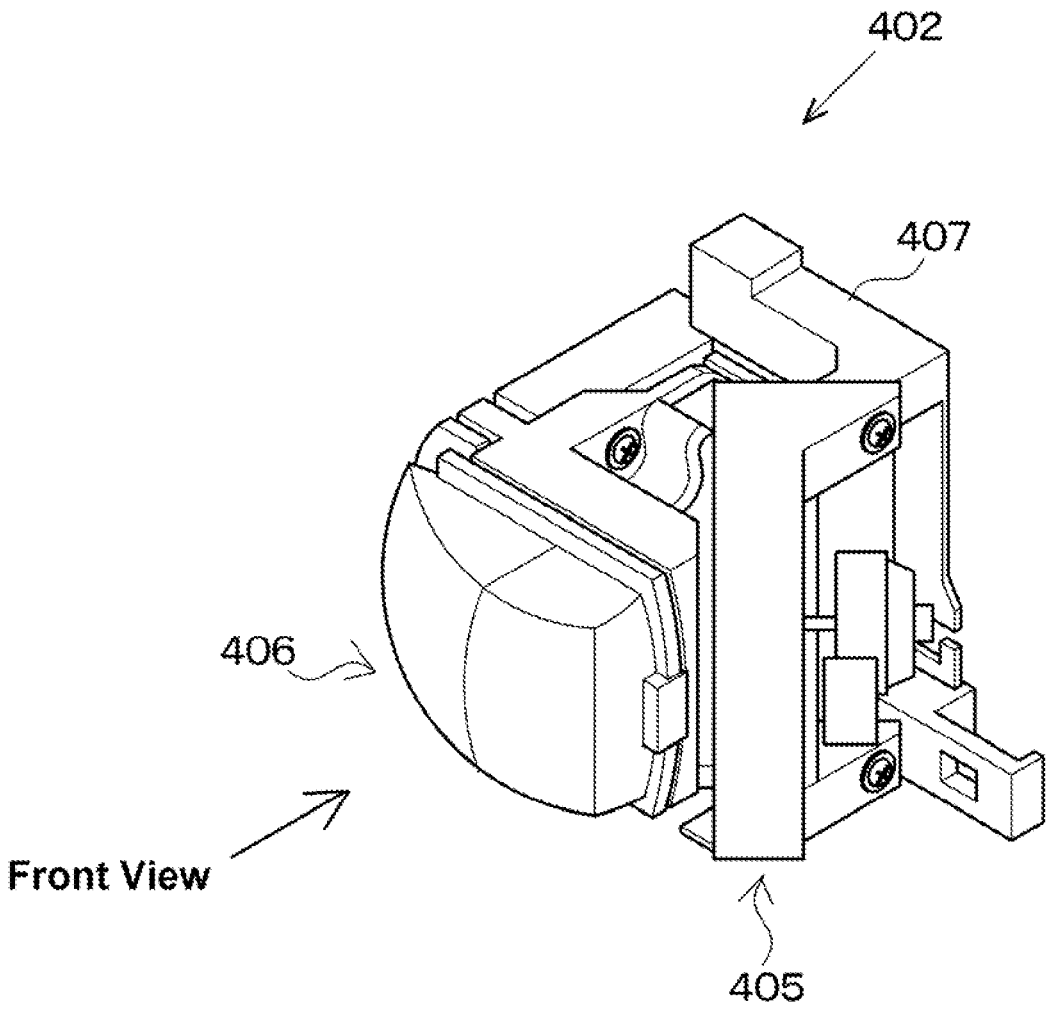
FIG. 23 is a perspective view of the lamp unit as seen from the front.

As shown in FIGS. 22-23, a lamp unit 402 of Embodiment 4 according to the present invention is disposed in a lamp chamber 413 formed between an outer lens 411 and a lamp body 412 of a vehicle lamp 401. The lamp unit 402 is comprised of first and second light source units 403 and 404 (see FIG. 24), a reflector module 405, and a lens unit 406. Additionally, an extension 413 is provided in the lamp chamber 414 to shield a part of the lamp unit 402 from the front of the lamp.

In addition, the lamp unit 402 has a support member 407 that supports first and second light source units 403 and 404, a reflector module 405, and a lens unit 406. The support member 407 has a heat sink 409 behind the mounting surfaces 407*a* and 407*b* (see FIG. 24) on which the first and second light source units 403 and 404 are mounted to dissipate the heat generated by the first and second light source units 403 and 404. The support member 407 is held to the lamp body 412 by an aiming adjustment member 415.

The light L1 emitted from the first light source unit 403 passes through the first lens 431 and enters the second lens 432. On the other hand, the light L2 emitted from the second light source unit 404 is reflected by the reflective surfaces 425*a* of the rotating reflector 425 and enters the second lens 432. The light L1 and L2 of the first and second light source units incident on the second lens 432 is projected to the front of the lamp. In this way, in order to cause the light L1 and the light L2 to enter the second lens 432, the substrates 423 and 424 are provided in a non-parallel manner.

Figure 24:
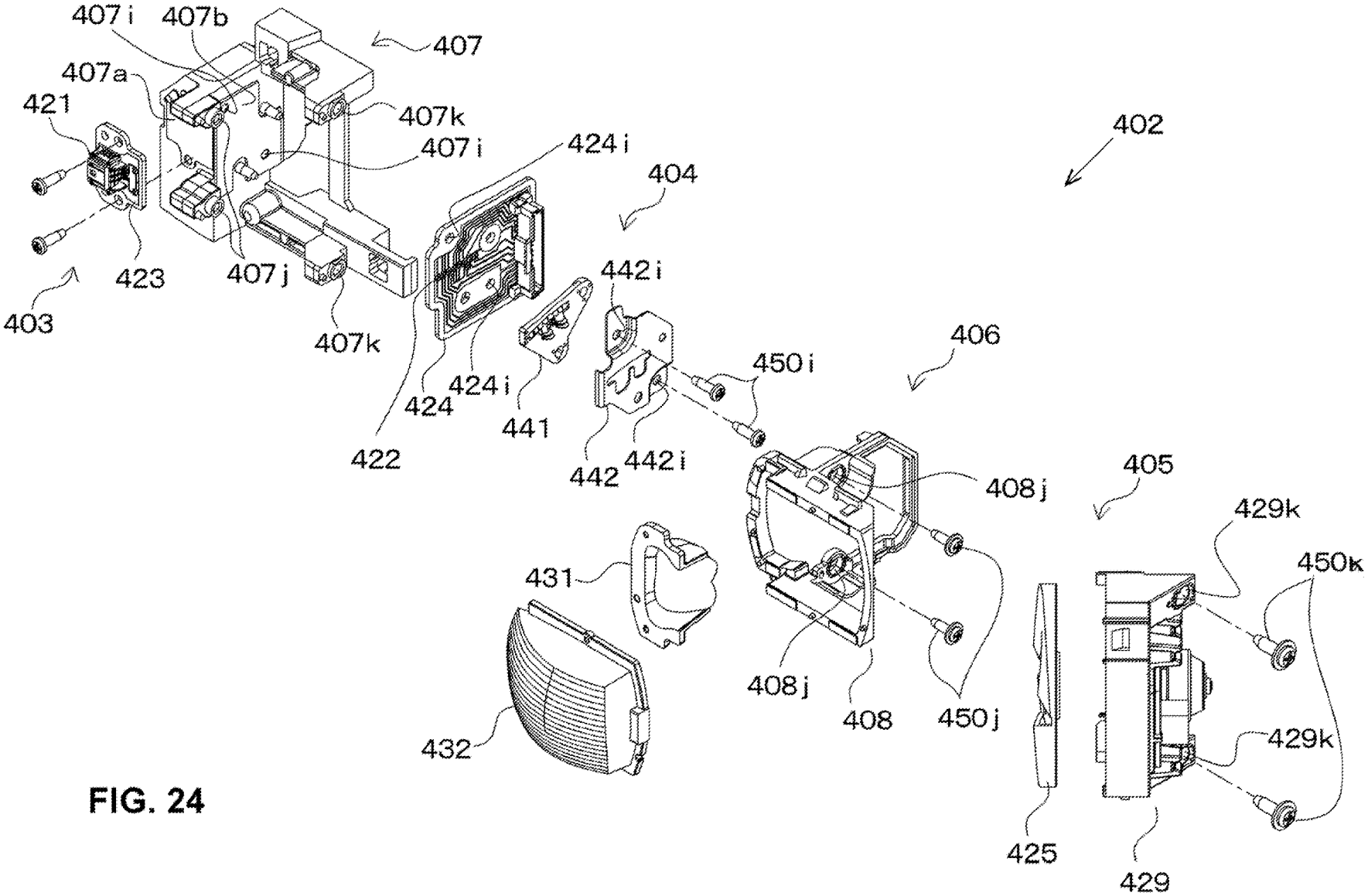
FIG. 24 is an exploded perspective view of the lamp unit.

As shown in FIG. 24, the first and second light source units 403, 404 are comprised of the light emitting elements 421, 422 and substrates 423, 424 on which the light emitting elements 421, 422 are mounted. The second light source unit 404 has a cover lens 441 that transmits light from the light emitting elements 422, and a fixing member 442 that secures the cover lens 441 to the substrate 424.

The substrate 424, the fixing member 442, a lens holder 408, and a reflector case 429 includes screw holes 424*i*, 442*i*, 408*j*, and 429*k* into which bar-shaped fastening members, i.e., screws 450*i*, 450*j*, and 450*k*, can be inserted. The screw holes 424*i*, 442*i*, 408*j*, and 429*k* are open towards the support member 407 in the same direction. The lamp unit 402 is assembled upon inserting screws 450*i* into the screw holes 424*i*, 442*i*, the screws 450*j* into the screw holes 408*j*, and the screws 450*k* into the screw holes 429*k*, and tightening these screws in the screw holes 407*i*, 407*j*, 407*k*, respectively, in the support member 407. In the lamp unit 402, the screws 450*i*, 450*j*, and 450*k* are arranged in parallel.

Figure 25A:
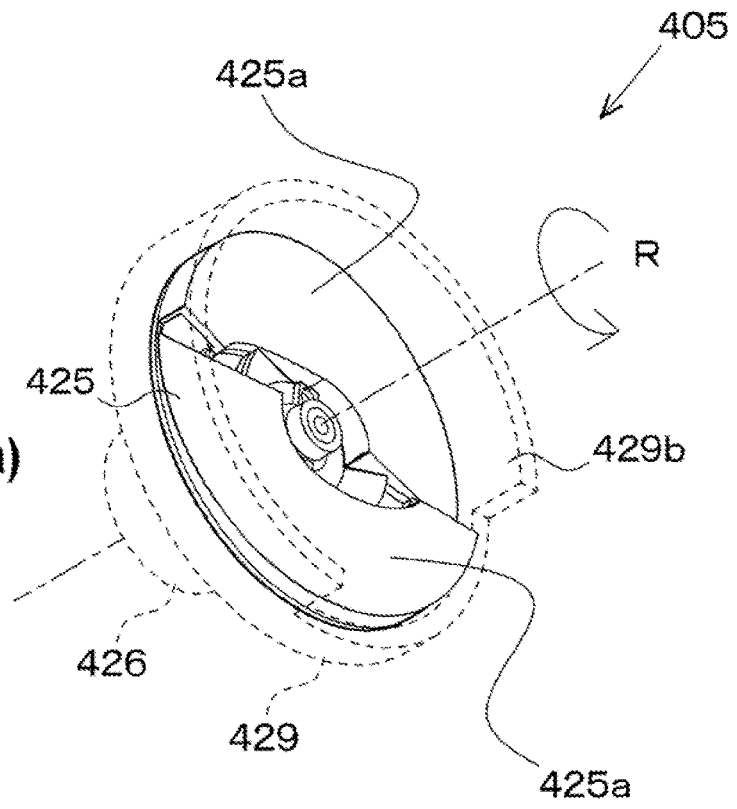
FIG. 25 is a schematic view of a reflector module.
Figure 25B:
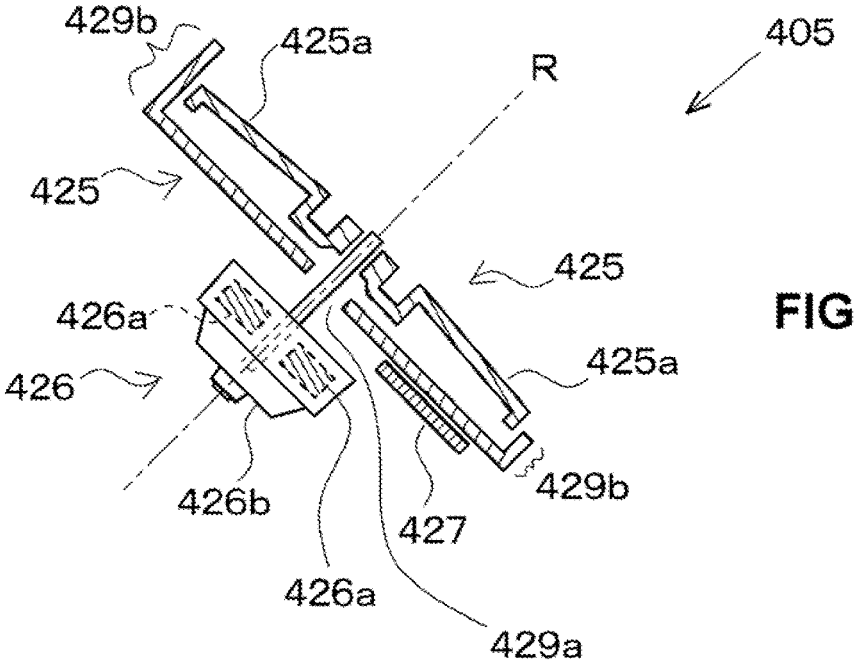

As shown in FIG. 25, the reflector module 405 includes the rotating reflector 425 comprising reflective surfaces 425*a* in an approximate shape of a split disk that are rotatable about the rotation shaft R, a motor 426 that drives the rotating reflector 425, and the reflector case 429 that holds the rotating reflector 426. The reflector case 429 has a vertical wall 429*b* surrounding the circumference of the rotating reflector 425.

As shown in FIG. 25(*b*), the rotary reflector 425 is connected to the rotating shaft R at the center thereof, and the rotating shaft R is connected to the motor 426 through a hole 429*a* opened in the bottom of the reflector case 429. Additionally, the motor 426 includes coils 426*a* and a yoke 426*b* that rotates when energized. A control circuit board 427 that has a control circuit mounted thereon to control the motor 426 is disposed on the outer bottom surface of the reflector case 429.

Figure 26A:
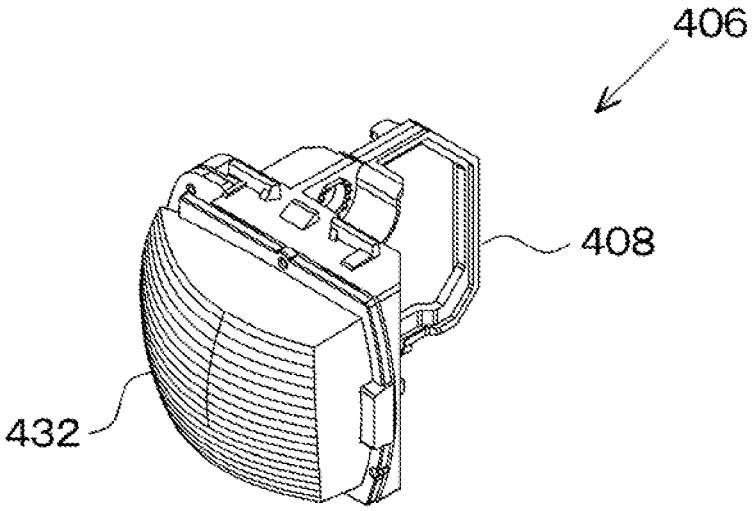
FIG. 26(*a*) is a perspective view of the lens unit, and FIG. 26(*b*) is an exploded perspective view thereof.
Figure 26B:
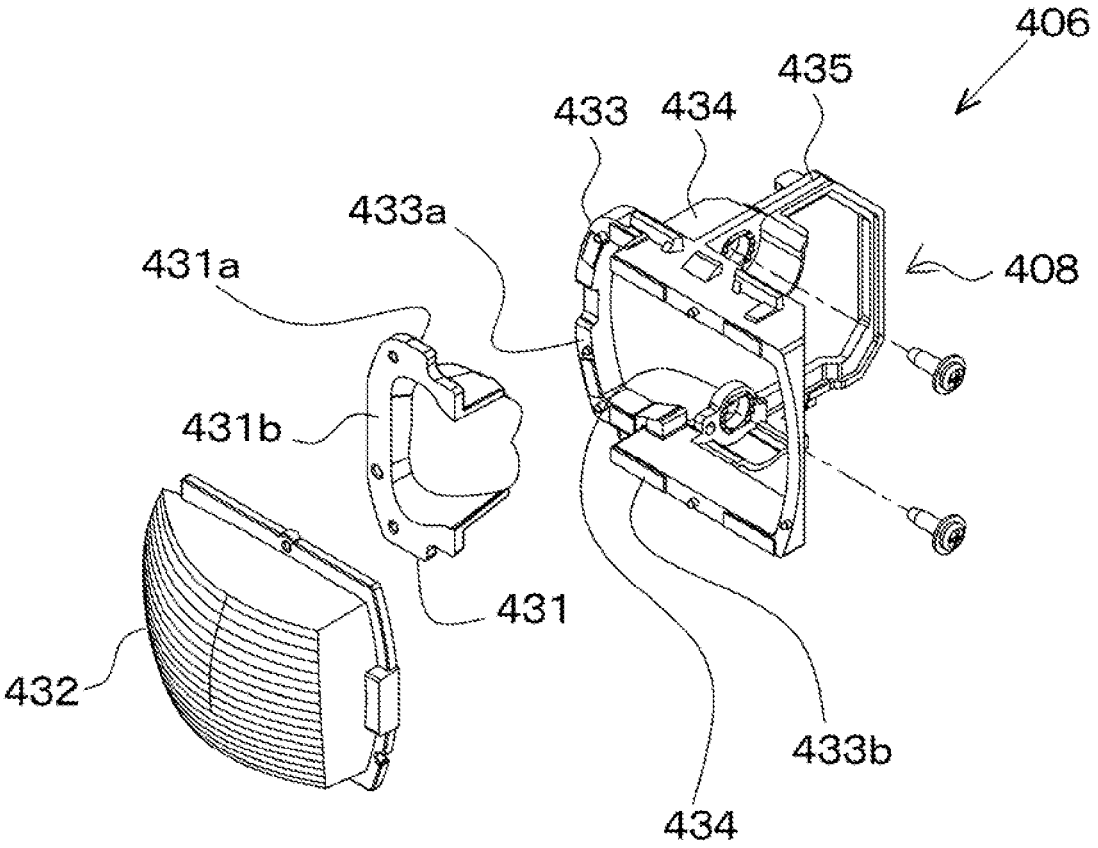

As shown in FIG. 26, the lens unit 406 is comprised of the first and second lenses 431 and 432 and the lens holder 408 that holds the first and second lenses 431 and 432. The lens holder 408 includes a main body 433 that holds the first and second lenses 431 and 432, fastening portions 434 that fastens the main body 433 to the support member 407 of the lamp unit 402, and a reinforcing member 435 that connects the plurality of fastening portions 434 to provide reinforcement.

As shown in FIG. 26(*b*), the main body 433 includes a retainer surface 433*a* that retains the first lens 431. The first lens 431 includes, on the opposite side of a retained surface 431*a* retained by the main body 433, a retainer surface 431*b* that retains the second lens 434. The second lens 432 is retained by the second lens retainer surface 431*b* of the first lens 431 and a second lens retainer surface 433*b* of the main body 433.

Figure 27A:
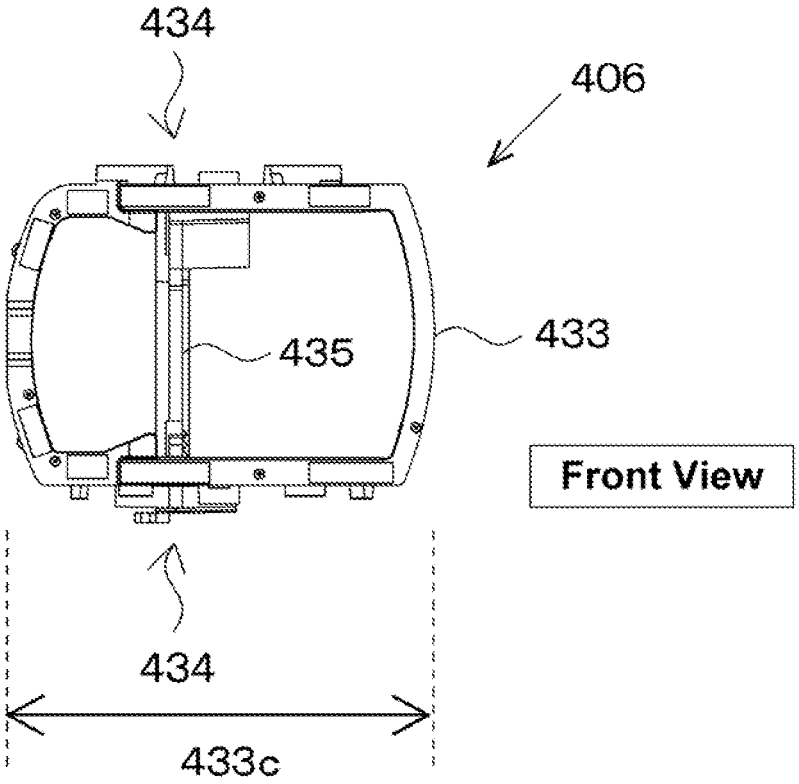
FIG. 27(*a*) is a front view of a lens holder, and FIG. 20(*b*) is a perspective view of the lamp unit on which the lens holder of FIG. 27(*a*) is mounted.
Figure 27B:
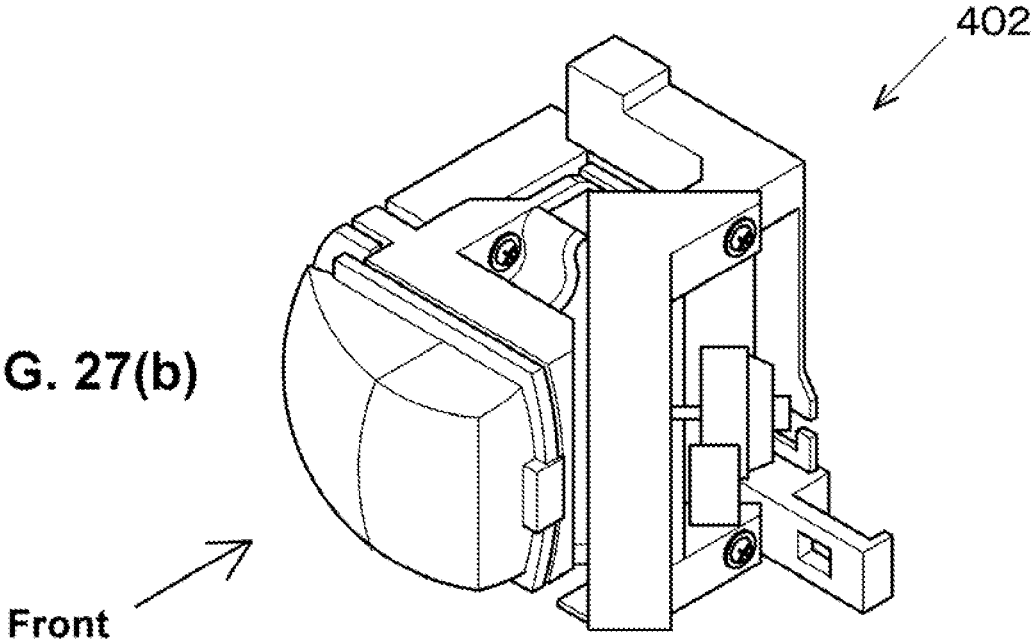

Moreover, as shown in FIG. 27(*a*), the main body 433 is formed in the shape of an approximate rectangular frame that includes a pair of long sides 433*c* as seen from the front. Additionally, a fastening portion 434 is provided at an approximate center of each of the pair of long sides 433*c*.

FIG. 27(*a*) is a front view of the lens holder 408. The main body 433 is formed in the shape of an approximate rectangular frame that includes a pair of long sides 433*c*. Additionally, a fastening portion 434 is provided at an approximate center of each of the pair of long sides 433*c*.

Figure 30A:
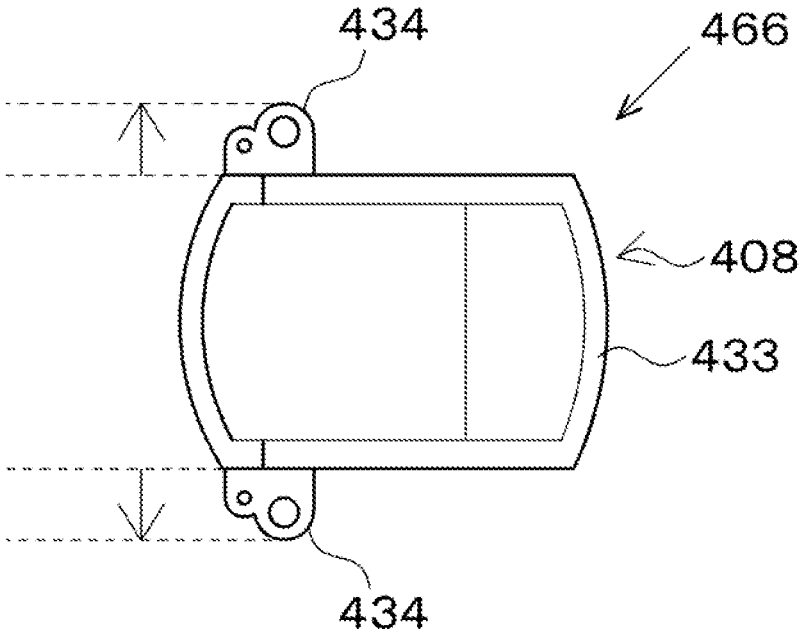
FIG. 30(*a*) is a plan view of a lens unit according to a conventional configuration, and FIG. 30(*b*) is a perspective view of the lamp unit on which the lens unit of FIG. 30(*a*) is mounted.
Figure 30B:
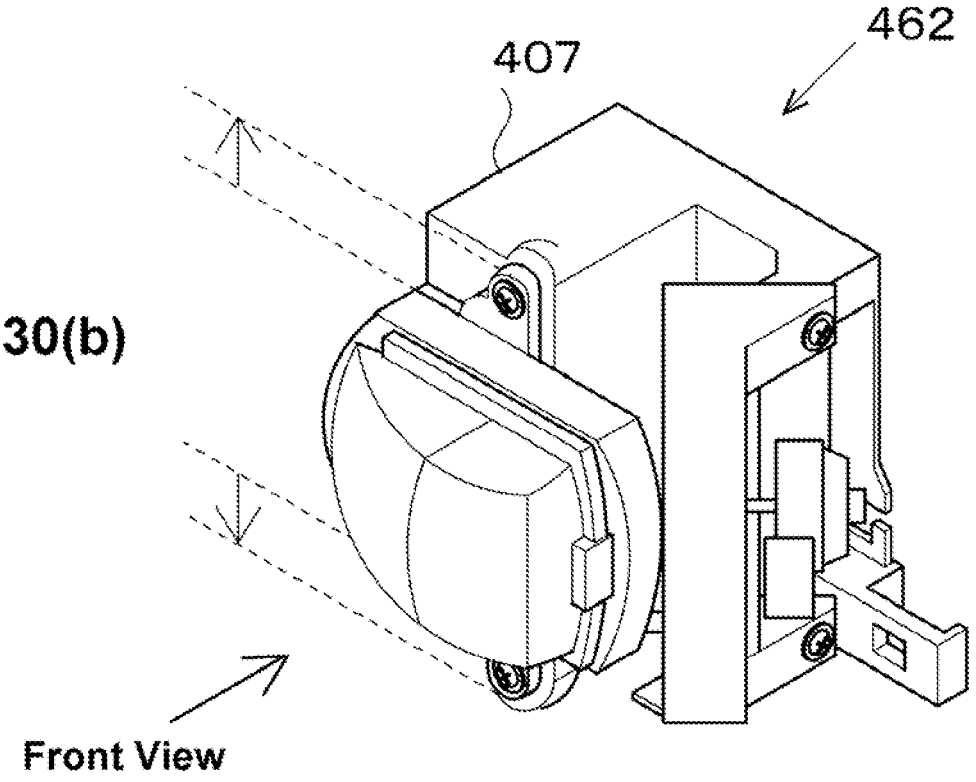

While fastening portions 434 protrude laterally from the lens in a conventional lens holder 468 (see FIG. 30(*a*)), the fastening portions of this embodiment are disposed where they are hard to be seen from the front. As a result, as shown in FIG. 27(*b*), in the lamp unit 402 according to the present invention, the lens portion presents a smaller area as seen from the front compared to the conventional lamp unit 462 (see FIG. 30(*b*)). The arrangement of the fastening portions 434 will be described in detail below.

Figure 28A:
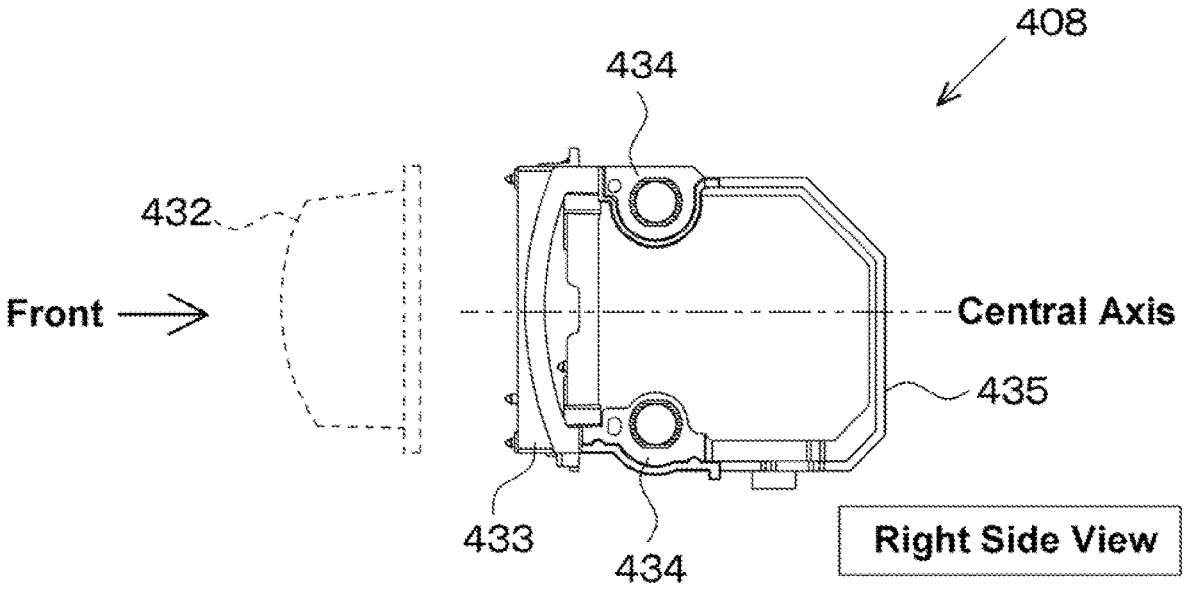
FIG. 28(*a*) is a right side view of the lens holder, and FIG. 28(*b*) is a plan view thereof.
Figure 28B:
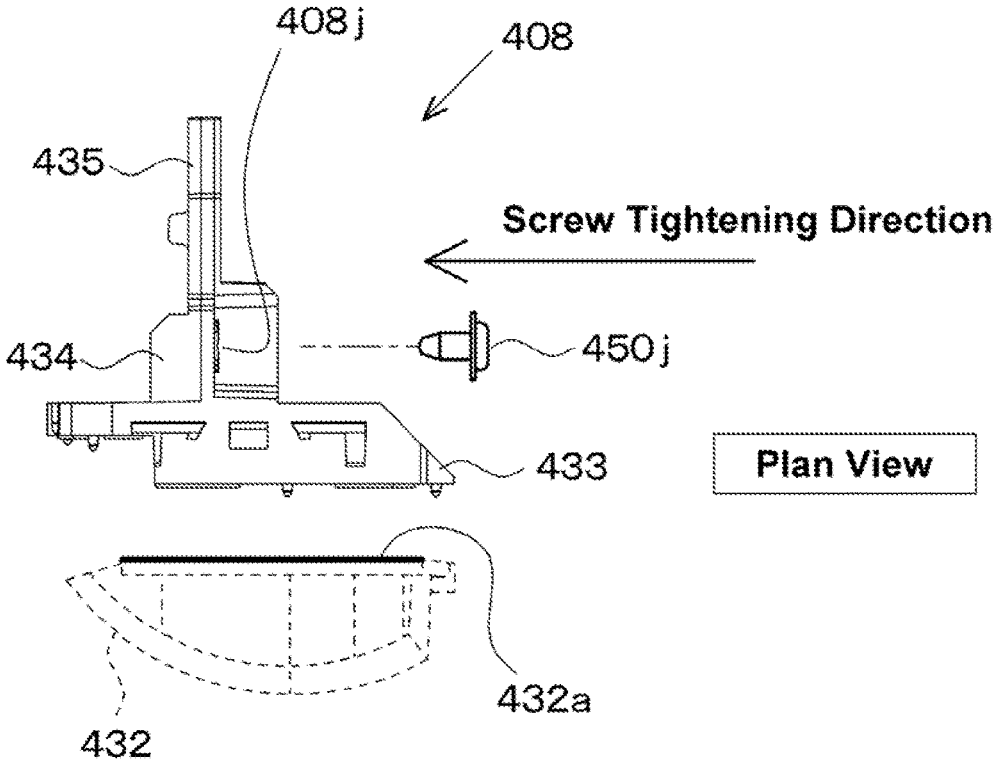

FIG. 28(*a*) is a right side view of the lens holder 408. The fastening portions 434 have their base ends on the main body 433 and are erected towards the rear of the lamp, and are placed where they are shielded by the second lens 432 and the main body 433 as seen from the front of the lamp unit. The fastening portions 434 can be provided in such a way as to protrude toward the central axis of the second lens 432 to the extent that they do not block the light beams incident on the second lens 432.

As shown in FIG. 28(*a*), the reinforcing member 435 have their base ends on one fastening portion 434 and the other fastening portion 434 and extends toward the rear of the lamp. In addition, in the lamp unit 402, the reinforcing member 435 is provided in an approximate U-shape surrounding three sides of the fixing member 442 of the second light source unit 404 (see FIG. 24).

As shown in FIG. 28(*b*), the fastening portions 434 have screw holes 408*j* through which screws 450*j* are inserted. The screw holes 408*j* are open in a parallel direction to the lens surface 432*a* of the second lens 432. With the screws 450*j* fastened to the support member 407, the central axes of the screws 450*j* are oriented parallel to the lens surface 432*a* of the second lens 432.

Figure 29A:
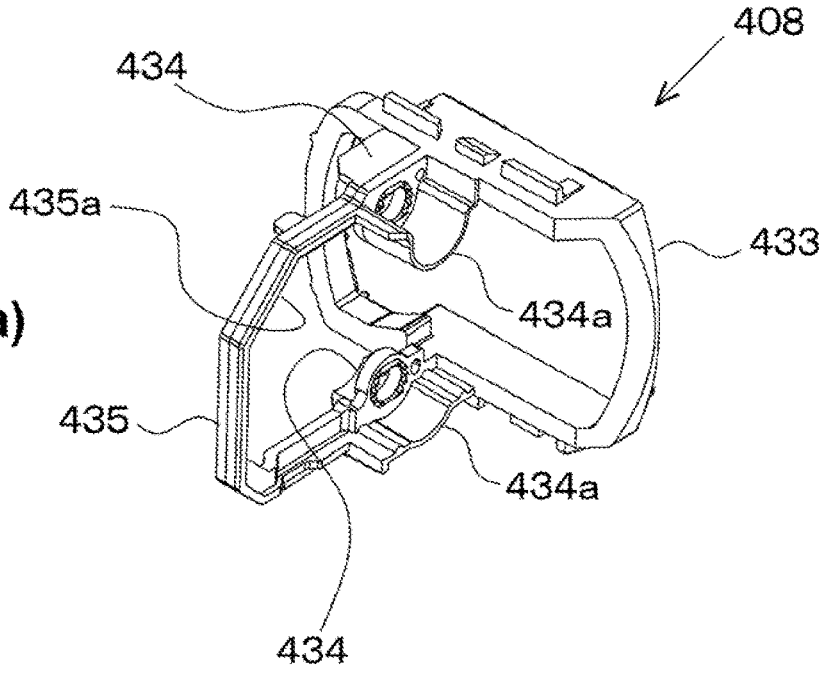
FIG. 29(*a*) is a perspective view of the lens holder as seen from the bottom, and FIG. 29(*b*) is a schematic view showing the positional relationship between the lens unit and the reflector module in the lamp unit.
Figure 29B:
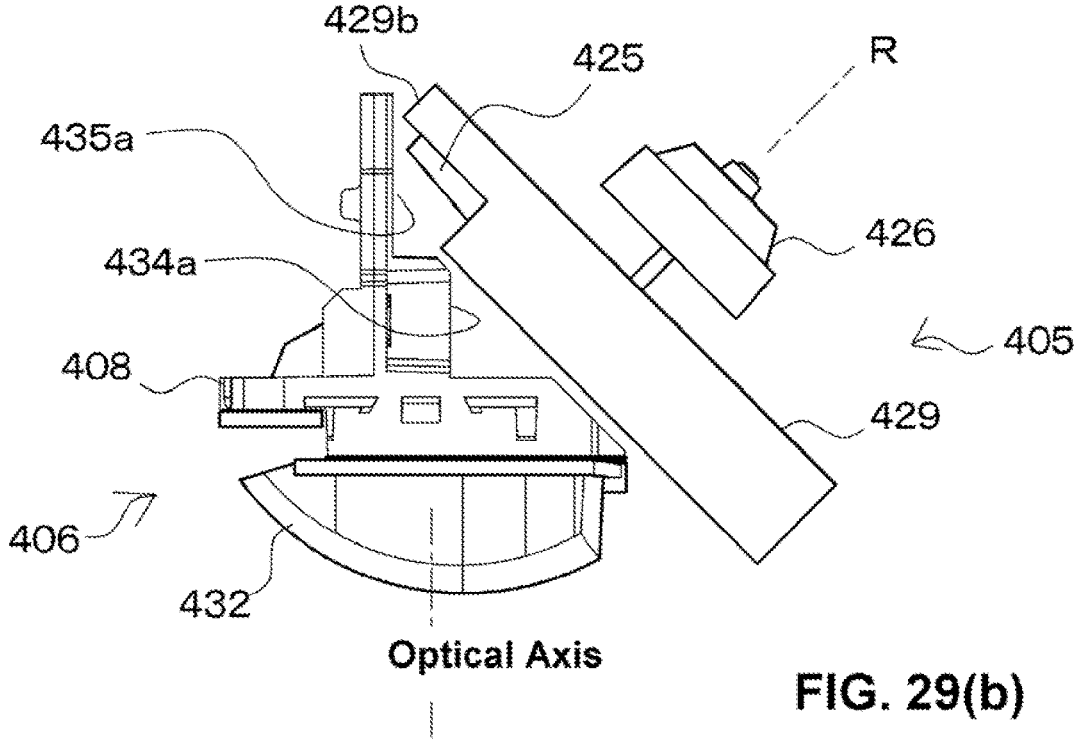

FIG. 29(*a*) is a perspective view of the lens holder 408 as seen from the bottom. The connecting portions 434 and the reinforcing member 435 are provided with ribs 434*a* and 435*a*, respectively. The ribs of the reinforcing member 435 are formed lower than the ribs 436 of the connecting portions 434.

FIG. 29(*b*) shows the positional relationship between the lens unit 406 and the reflector module 405 in the lamp unit 402. The rotating reflector 425 is supported so that the rotating shaft R and the optical axis of the second lens 432 are not parallel to each other, and the ribs 434*a* and 435*a* are both erected towards the reflector case 429. The ribs 435*a* of the reinforcing member 435 have a lower height than that of the ribs 434*a* of the fastening portions 434, and the vertical wall 429*b* of the reflector case 429 is disposed in the area of the lower rib 435*b* of the reinforcing member 435. Thus, since the height of the ribs 435*a* of the reinforcing member 435 is lower than the ribs 434*a* of the fastening portions 434, the reflector module 405 and the lens unit 406 can be arranged in close proximity with each other without causing interference between the reflector case 429 and the reinforcing member 435, which allows the lamp unit 402 to be made more compact.

According to the lamp unit 402 of the above configuration, the fastening portions 434 are arranged so that they do not protrude from the second lens 432 and the main body 433 in the front view of the lamp unit 402, thus providing a remarkable effect of improving the appearance of the lamp unit 402. Also, as the lens holder 408 can be fastened from the same direction as the substrate 424 and the reflector case 429, the time and effort required for the assembly work can also be effectively reduced. Furthermore, by providing the reinforcing member 435, it is possible to prevent torsion of the fastening portion 434 while the screws 450*j* are fastened, and once the screws are fastened, the approximate U-shape can be engaged with the fixing member 442 to prevent the lens holder 408 from rattling or falling off.

It should be noted that the present invention is not limited to Embodiments 1-4 above and can also be practiced by changing the shape or the configuration of some components as appropriate without departing from the spirit of the present invention, for example, as set forth below:

(1) For example, it is preferred to provide a protruding portion on the substrate 61*b* and to block light L2 emitted by the second light source 62*a* and directed to the projection lens 93 without being routed via the inner lens 92 and/or the rotating reflector 8.

(2) The retainer member 336 may also be erected as a pinch, instead of the shielding wall 336*a* and the engaging portion 336*b*, that is provided with a gripper at the top thereof to support the harness 358 from both sides thereof. In addition, the rotating reflector 331 may be comprised of any number of blades 351, single or multiple, having a reflective surface 331*a*, and the blades can be provided as triangular, rectangular, or various other polygonal shaped plate members.

LIST OF REFERENCE NUMERALS

1 Vehicle headlamp
2 Lamp body
3 Translucent cover
4 Lamp chamber
5 Lamp unit
7 Heat radiation fins
8 Reflector module
9 Lens holder
10 Support member
11 Aiming adjustment member
12 Extension reflector
13 Heat-dissipating grease
81 Rotating reflector
82 Reflector case
83 Motor
61, 62 Lighting source unit (a: light source, b: substrate, c: protruding portion)
91, 92 Inner lenses
93 Projection lens
201 Vehicle lamp
202 Lamp unit
203 First light source unit
204 Second light source unit
205 Reflector module
206 Lens unit
207 Support member
208 Lens holder
209 Heat sink
211 Outer lens
212 Lamp body
213 Lamp chamber
214 Extension
215 Aiming adjustment member
221, 222 Light emitting elements
223, 224 Substrates
225 Rotating reflector (a: reflective surface)
226 Motor
227 Control circuit board
229 Reflector case (a: vertical wall)
231 First lens
232 Second lens (projection lens)
241 Cover lens (a: light distribution control portion, b: leg portion)

242 Fixing member (a: opening, b: vertical wall)
301 Vehicle lamp
302 Lamp chamber
303 Lamp unit
304 Reflector module
305, 306 Light emitting elements
307, 308 Light emitting element substrates
309 Support member
310 Projection lens
311 Inner lens
312 Outer lens
313 Lamp body
314 Extension
321 Mounting surface
331 Rotating reflector (a: reflective surface, b: front side)
332 Motor
333 Case
334 Vertical wall (a: cutout, b: top end plane)
335 Cover (a: opening)
336 Retainer member (a: shielding wall, b: engaging portion)
351 Blade
354 Yoke portion
355 Control circuit
356 Control circuit board
358 Harness
401 Vehicle lamp
402 Lamp unit
403 First light source unit
404 Second light source unit
405 Reflector module
406 Lens unit
407 Support member
408 Lens holder
409 Heat sink
411 Outer lens
412 Lamp body
413 Lamp chamber
414 Extension
421, 422 Light emitting elements
423, 424 Substrates
425 Rotating reflector
426 Motor
427 Control circuit board
429 Reflector case
430 Vertical wall
431 First lens
432 Second lens
433 Body portion
434 Fastening portion
435 Reinforcing member
441 Cover lens
442 Fixing member
450 Screw
L, L1, L2, L3, L4 Light
Y Range
R Rotating shaft

The invention claimed is:

1. A lamp unit, comprising a light emitting element, a substrate on which the light emitting element is mounted, a rotating reflector for rotating a reflective surface about a rotating shaft, the reflective surface reflecting light of the light emitting element a rotating reflector case that holds the rotating reflector, a projection lens for projecting the light traveling via the reflective surface to a lamp front, a lens bolder that holds the projection lens, and a support member that supports the substrate, the rotating reflector, and the lens holder, the lamp unit including, a cover lens that is disposed between the light emitting element and the reflective surface and made of a transparent member that transmits the light emitted by the light emitting element, and a fixing member that secures the cover lens to the substrate, the lamp unit being characterized in that the fixing member blocks part of the light emitted from the cover lens.

2. The lamp unit of claim 1, wherein the cover lens includes a light distribution control portion for projecting the light emitted from the light emitting element to the reflective surface of the rotating reflector, the cover lens further including a leg portion integrally molded with the light distribution control portion, wherein the fixing member includes an opening that exposes the light distribution control portion, and wherein the fixing member blocks the part of the light emitted from the cover lens that does not enter the light distribution control portion.

3. The lamp unit of claim 1, wherein the fixing member includes a vertical wall on at least part of a peripheral edge of the opening, the vertical wall blocking part of the light emitted by the light emitting element.

4. The lamp unit of claim 1, wherein the fixing member includes a vertical wall on at least part of a peripheral edge of the opening, and wherein the vertical wall blocks part of the light emitted by the light emitting element that is not projected to the rotating reflector.

5. The lamp unit of claim 1, wherein the fixing member includes a vertical wall on at least part of a peripheral edge of the opening, and wherein the vertical wall is interposed between the projection lens and the cover lens.

6. A reflector module comprising a reflector with a reflective surface on a front sick and a case that contains the reflector, the reflector module being characterized in that a vertical wall is provided on a periphery of an inner bottom surface of the case, the vertical wall enclosing an outer peripheral surface of the reflector, and that a motor is disposed on a back side of the reflector for rotating the reflector about a rotating shaft via a bottom of the case, wherein the motor includes a motor drive unit for driving the motor, wherein a cover is provided on an outer bottom surface of the case to cover at least part of the motor drive unit, wherein the motor drive unit includes a yoke portion and a control circuit board on which a control circuit for controlling the yoke portion is mounted, wherein the cover includes an opening that exposes part of the yoke portion, and wherein a gap formed between the yoke and the control circuit board is provided where the gap is not exposed via the opening.

7. The reflector module of claim 6, wherein the front side of the reflector is contained further inward than a top end plane of the vertical wall.

8. The reflector module of claim 6, wherein a cover is provided on an outer bottom surface of the case to cover at least part of the motor drive unit, and wherein a retainer member is provided on an outer bottom surface of the cover to retain, in a predetermined position, a wiring member used to supply power to the motor.

9. The reflector module of claim 6, wherein a cover is provided on an outer bottom surface of the case to cover at least part of the motor drive unit, wherein a retainer member is provided on an outer bottom surface of the cover to retain, in a predetermined position, a wiring member used to supply power to the motor, wherein the retainer member includes a shielding wall that shields the wiring member used to supply power to the motor and the yoke portion from coming into contact with each other, and wherein an engaging portion that supports the wiring member from both sides thereof is provided in a portion of the shielding wall.

10. A lamp unit, comprising a light emitting element a substrate on which the light emitting element is mounted, a rotating reflector for rotating a reflective surface about a rotating shaft, the reflective surface reflecting light of the light emitting element, a rotating reflector case that holds the rotating reflector, a lens for projecting the light traveling via the reflective surface to a lamp front, a lens holder that holds the lens, and a support member that supports the substrate, the rotating reflector, and the lens holder, wherein the lens holder includes a main body that holds that lens and fastening portions that fasten the main body to the support member, and the lamp unit characterized in that the fastening portions have base ends thereof on the main body and are erected towards a lamp rear, the fastening portions being disposed where the fastening portions are shielded by the lens and the main body as seen from a front of the lamp unit.

11. The lamp unit of claim 10, wherein the lens holder includes two or more of the fastening portions and an approximately U-shaped reinforcing member that has base ends thereof on one fastening portion and another fastening portion and extends toward the lamp rear.

12. The lamp unit of claim 10, wherein the lens holder includes two or more of the fastening portions, wherein the main body is formed in a shape of an approximate rectangular frame, and wherein the fastening portions arc provided in approximate centers of a pair of long sides of the main body.

13. The lamp unit of claim 10, wherein the lens holder includes two or more of the fastening portions, wherein the fastening portions have a bole into which a bar-shaped fastening member is inserted, and wherein the holes are open in a direction parallel to a lens surface of the lens.

14. The lamp unit of claim 10, wherein the substrate and the rotating reflector case have holes into which a bar-shaped fastening member can be inserted, and which the holes in the substrate and the rotating reflector case are open in the same direction as the holes in the lens holder.

15. The lamp unit of claim 10, wherein the lens holder includes two or more of the fastening portions and an approximately U-shaped reinforcing member that has base ends thereof on one fastening portion and another fastening portion and extends toward the lamp rear, wherein the rotating reflector case and the lens holder are supported by the support member in positions where the rotating shaft of the rotating reflector is not parallel to an optical axis of the lens, wherein the fastening portions and the reinforcing member of the lens holder include ribs erected toward the rotating reflector case, and wherein the ribs of the reinforcing member are lower than the ribs of the connecting portions.

* * * * *